US005790158A

United States Patent [19]

Shinada et al.

[11] Patent Number: 5,790,158

[45] Date of Patent: Aug. 4, 1998

[54] INK-JET RECORDING APPARATUS AND INK TANK CARTRIDGE THEREFOR

[75] Inventors: Satoshi Shinada; Seiji Mochizuki; Yoshinori Miyazawa; Takao Kobayashi; Hisashi Koike; Yukiharu Suda, all of Suwa, Japan

[73] Assignee: Seiko Epson Corporation, Tokyo, Japan

[21] Appl. No.: 478,170

[22] Filed: Jun. 7, 1995

Related U.S. Application Data

[63] Continuation-in-part of Ser. No. 928,936, Aug. 11, 1992, Pat. No. 5,488,401.

[30] Foreign Application Priority Data

| | | | |
|---|---|---|---|
| Jan. 28, 1992 | [JP] | Japan | 4-12834 |
| Feb. 19, 1992 | [JP] | Japan | 4-32226 |
| Mar. 16, 1992 | [JP] | Japan | 4-58151 |
| Jun. 26, 1992 | [JP] | Japan | 4-193402 |
| Sep. 16, 1994 | [JP] | Japan | 6-248516 |
| Apr. 20, 1995 | [JP] | Japan | 7-119289 |

[51] Int. Cl.[6] ..... B41J 2/175

[52] U.S. Cl. ..... 347/86

[58] Field of Search ..... 347/85, 86, 87; 222/81

[56] References Cited

U.S. PATENT DOCUMENTS

| | | | |
|---|---|---|---|
| 4,162,501 | 7/1979 | Mitchell et al. | 347/86 |
| 4,183,031 | 1/1980 | Kyser et al. | 101/366 |
| 4,368,478 | 1/1983 | Koto | 347/89 |
| 4,689,642 | 8/1987 | Sugitani | 347/87 |
| 4,757,331 | 7/1988 | Mizusawa | 347/85 |
| 4,999,652 | 3/1991 | Chan | 347/86 |
| 5,070,346 | 12/1991 | Mochizuki et al. | 347/7 |
| 5,119,115 | 6/1992 | Buat et al. | 347/86 |
| 5,231,416 | 7/1993 | Terasawa et al. | 347/23 |
| 5,244,092 | 9/1993 | Karita et al. | 206/462 |
| 5,279,410 | 1/1994 | Arashima et al. | 206/723 |
| 5,453,771 | 9/1995 | Waseda et al. | 347/86 |

FOREIGN PATENT DOCUMENTS

| | | |
|---|---|---|
| 0 117 718 | 2/1984 | European Pat. Off. . |
| 1 001 205 | 5/1988 | European Pat. Off. . |
| 0 408 241 | 4/1990 | European Pat. Off. . |
| 0 439 728 A2 | 8/1991 | European Pat. Off. . |
| 0 529 625 | 8/1992 | European Pat. Off. . |

(List continued on next page.)

OTHER PUBLICATIONS

Patent Abstract of Japan vol. 011 No. 196 (24 Jun. 1987).

Patent Abstracts of Japan vol. 011 No. 339 (Nov. 6, 1987).

Patent Abstract of Japan, vol. 12, No. 364 (M–747) Dec. 29, 1988) JP 63 118257.

Patent Abstracts of Japan JP–A–63 154356, 27 Jun. 1988.

*Primary Examiner*—Benjamin R. Fuller
*Assistant Examiner*—Craig A. Hallacher
*Attorney, Agent, or Firm*—Stroock & Stroock & Lavan LLP

[57] ABSTRACT

An ink tank cartridge for an ink-jet type recording apparatus being removably mounted onto an ink supply needle of a recording body is provided. The ink tank cartridge is provided with a first chamber for storing ink and a second chamber for storing a porous member having ink impregnated therein. The second chamber communicates with the first chamber through a passageway formed within the cartridge between the first and second chambers. An ink supply port extends through and projects from a wall of the second chamber. The ink supply port supplies inks to the ink-jet recording apparatus through said porous member. A funnel-shaped packing member is provided within the ink supply port. The packing member is formed with a hole therethrough having a wide end and a narrow end and is dimensioned to receive the ink supply needle and to resiliently abutt against an outer periphery of the ink supply needle. The packing member is formed for preventing the flow of ink through the ink supply port other than through the ink supply needle when the needle is positioned in the ink supply port. The wide end of the hole is disposed away from the porous member.

62 Claims, 18 Drawing Sheets

FOREIGN PATENT DOCUMENTS

| | | |
|---|---|---|
| 0 553 535 | 8/1992 | European Pat. Off. . |
| 0 581 531 | 2/1994 | European Pat. Off. . |
| 2 399 957 | 7/1978 | France . |
| 2 725 270 | 12/1977 | Germany . |
| 2 812 562 | 9/1979 | Germany . |
| 50-74341 | 10/1973 | Japan . |
| 63118257 | 3/1988 | Japan . |
| 2-187364 | 7/1990 | Japan . |
| 3-92356 | 4/1991 | Japan . |
| 2 003 793 | 3/1979 | United Kingdom . |

INK-JET RECORDING APPARATUS AND INK TANK CARTRIDGE THEREFOR

CROSS-REFERENCE TO RELATED APPLICATION

This is a continuation-in-part of application Ser. No. 07/928,936 filed on Aug. 11, 1992 now U.S. Pat. No. 5,488,401.

BACKGROUND OF THE INVENTION

This invention relates generally to an ink-jet type recording apparatus for ejecting ink droplets onto a recording medium, and more particularly, to a structure of an ink tank cartridge for use in a ink-jet type recording apparatus.

In a conventional recording apparatus, ink is supplied to a recording head from an ink tank constructed as a cartridge. The benefits of using an ink cartridge serving as an ink tank is that ink does not smear due to the leakage of ink while refilling new ink or the like. However, undesired air bubbles easily enter the ink tank which cause problems such as an ink failure.

In order to prevent air bubbles from entering the ink tank, several techniques have been proposed. For example, Unexamined Japanese Patent Application (OPI) No. Hei. 3-92356 discloses an ink-jet recording apparatus in which an ink supply port is disposed below an ink tank. The tank is formed with a rubber tap and a metal ink supply needle which penetrates through the rubber tap to form an ink flow path that communicates with ink nozzles of the recording head. To easily penetrate through the rubber tap, the ink supply needle is provided with ink supply holes on a side surface thereof. The supply holes have a diameter about 1 mm. The needle is constructed from a metal pipe formed of an anti-corrosion material such as stainless steel. Moreover, the tip of the pipe is extremely sharp to penetrate the rubber tap. Accordingly, the user must operate the sharpened needle very carefully or be subjected to potential injury.

To overcome the above problem, Unexamined Japanese Patent Application (OPI) No. Sho. 50-074341 proposes a solution. In this arrangement, a packing member is provided with a throughhole positioned at an end opening of an ink supply port. The throughhole of the packing member is sealed by a sealing member. Based thereon, the ink supply needle does not require an extremely sharp tip, since it is penetrating a seal member and not a rubber tap as in the prior art. However, in a conventional ink-jet recording apparatus using an ink tank which stores liquid ink directly therein, the apparatus suffers from several problems such as leakage of ink or a pressure difference which is due to an increase in pressure while penetrating the ink supply needle.

Furthermore, it is preferable to keep the ink supply pressure as a negative pressure from the ink tank to the recording head within a range from −30 to −100 mmAq (waterhead) to achieve a stable ink ejection of the recording head of the ink-jet type recording apparatus. However, due to the height level at which the ink tank is installed, it is difficult to control the ink supply pressure. This is particularly true when the ink-jet recording apparatus is configured with a carriage type system wherein a recording head and an ink tank cartridge are mounted on the carriage. Unexamined Japanese Patent Application (OPI) No. Hei. 2-187364 proposes that a porous member be housed within an ink tank (cartridge) to thereby generate a negative pressure between the ink tank and the recording head due to the capillary action of the porous member.

Japanese Patent Application Hei. 2-187364 is directed to one type of recording apparatus by which both an ink tank and a recording head are unitarily formed. When the ink contained in the ink tank is emptied, both of these components are replaced. Moreover, this application is silent with respect to the other problems or difficulties such as undesired air flow to the recording head or leakage of ink which may occur when the ink tank is selectively removed from the head.

Japanese Patent No. Hei. 3-61592 suggests 20 Torr as an appropriate negative pressure level for packing the ink tank cartridge. This negative pressure is much greater than the negative pressure under which the ink is filled within the tank. In fact, the negative pressure may cause a problem, because the ink tank cartridge may have atmospheric pressure previously applied thereto during the manufacturing process and because of the necessity of moving a filled cartridge some distance to the packaging station. Moreover, the timing for the ink-filling process and that for the packaging process are usually spaced far from each other. Therefore, air penetrating into the ink may be freed and produce air bubbles when a negative pressure applied during the packaging process is greater than that for the ink- filling process. As a result thereof, an undesirable ink-leakage may occur. Further, air bubbles generated in the porous member may obstruct the ink flowing from the ink tank cartridge to the recording head which could cause an ink-failure during the printing operation.

A prior art ink jet printer in which an ink containing unit and an ink jet recording head are mounted on a carriage is disclosed in European Patent Publication No. 581,531. In the disclosed printer, in order to prevent printing failures caused by variation of the ink level or air bubbles due to movement of the ink cartridge, which is caused by the movement of the carriage, the ink container is divided into two regions. A first region of the container adjacent the recording head houses ink impregnated in a porous member, and a second region contains liquid ink without a porous member. This structure enables the ink to be conducted to the recording head via the porous member so that the problems arising from movement of the ink in the cartridge are prevented from occurring to a certain extent.

The porous member is held in fluid communication with the recording head by a projecting member which is inserted through a hole formed in the side portion of the container. However, such a structure cannot be applied to a recording head in which air bubbles must be stopped from entering a pressurized chamber, such as that for an ink jet printer in which a piezoelectric vibrator is used as an actuator for ink ejection.

Accordingly, it is desirable to provide an ink tank cartridge in an ink-jet type recording apparatus which does not require a sharpened needle, is capable of preventing air (gas) from entering the ink supply path of the recording apparatus body even when the ink tank is replaced from the ink supply needle and has a high air tightness between the ink supply needle and the ink tank.

SUMMARY OF THE INVENTION

Generally speaking, in accordance with the invention, an ink tank cartridge for an ink-jet type recording apparatus being removably mounted onto an ink supply needle of a recording body is provided. The ink tank cartridge is provided with a first chamber for storing ink and a second chamber for storing a porous member having ink impregnated therein. The second chamber communicates with the first chamber through a passageway formed within the cartridge between the first and second chambers. An ink supply port extends through and projects from a wall of the second chamber. The ink supply port supplies inks to the ink-jet recording apparatus through said porous member. A funnel-shaped packing member is provided within the ink supply port. The packing member is formed with a hole therethrough having a wide end and a narrow end and is dimensioned to receive the ink supply needle and to resiliently abut against an outer periphery of the ink supply needle. The packing member is formed for preventing the flow of ink through the ink supply port other than through the ink supply needle when the needle is positioned in the ink supply port. The wide end of the hole is disposed away from the porous member.

Accordingly, it is an object of the invention to provide an improved ink tank cartridge for an ink jet recording apparatus.

Yet still another object of the invention is to provide an ink tank cartridge which is capable of preventing air from entering the ink supply path of the recording apparatus body even when the ink tank is replaced from the ink supply needle.

Still another object of the invention is to provide an ink tank cartridge which has a high air tightness between the ink supply needle and the ink tank.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying swings, in which:

FIG. 18(*b*) is a bottom plan view showing the lid with a seal affixed thereto;

FIG. 19(*b*) is a cross-sectional view of the packing member prior to insertion;

FIG. 23(*b*) is a cross-sectional view taken along line 23—23 of FIG. 23(*a*);

FIG. 24(*b*) is a cross-sectional view taken along line 24—24 of FIG. 24(*a*);

FIG. 25(*b*)is a cross-sectional view showing an ink cartridge constructed in accordance with a sixth additional embodiment of the invention;

DESCRIPTION OF THE PREFERRED EMBODIMENTS

Figure 1:
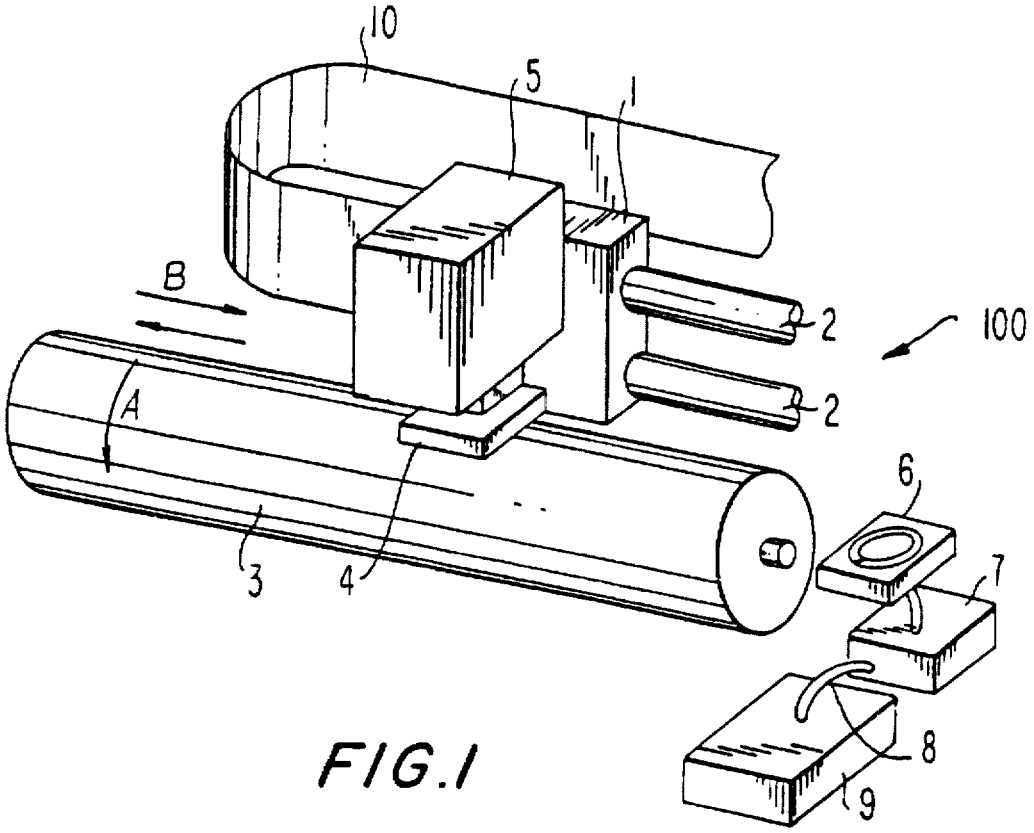
FIG. 1 is a perspective view of an ink-jet type recording apparatus wit an ink tank cartridge attached thereto in accordance with the present invention.

Referring now to FIG. 1, an ink-jet type recording apparatus having an ink tank cartridge, generally indicated at 100, in accordance with the present invention is disclosed. Ink-jet type recording apparatus 100 is provided with a carriage 1 slidably mounted on guide shafts 2 with respect to a longitudinal axis of a platen 3 rotatable in the direction of Arrow A. Carriage 1 is reciprocally displaceable in the direction of arrows B. An ink-jet recording head 4 is provided for ejecting ink droplets towards platen 3 in accordance with a print signal. In addition, an ink tank cartridge 5 is provided for supplying ink to recording head 4. A capping apparatus 6 is disposed outside the printing region of the apparatus, but positioned so that it engages with a front surface of recording head 4. This engagement prevents the nozzle openings of recording head 4 from drying out, while the printing action is paused. The nozzle openings are sealed by capping member 6 and are forced to eject ink and air, if any, in the ink passages of recording head 4 by a negative pressure generated by a vacuum pump 7. The nozzle openings eject ink immediately after ink tank cartridge 5 is replaced with a new cartridge or when the nozzle opening's ink ejection ability is lowered during continuous printing operation. The ejected ink is drained toward an ink storage tank 9 through a pipe 8 and stored therein. Further, apparatus 100 is provided with a transmission cable 10 for transmitting printing signals to recording head 4.

Figure 2:
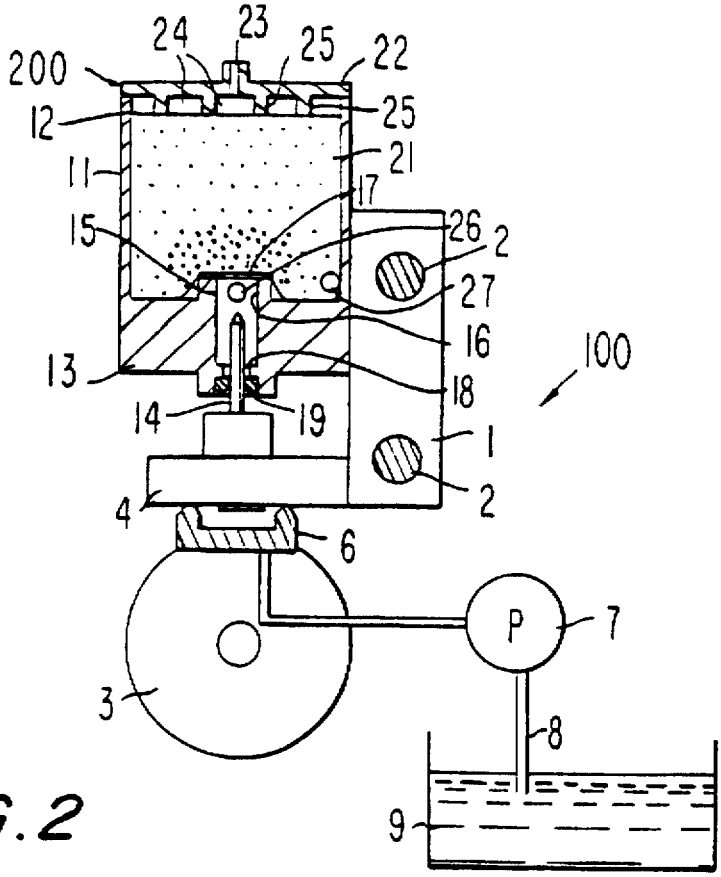
FIG. 2 is a sectional view of a first embodiment of the ink tank cartridge coupled the recording apparatus.

Referring now to FIG. 2, an embodiment of an ink tank cartridge 200 constructed in accordance with the present invention is shown. Ink tank cartridge 200 is applied to recording apparatus 100 as shown in FIG. 1. Ink tank cartridge 200 is provided with a housing 11 constituting an ink tank cartridge body. Housing 11 is unitarily formed with an opening 12 at a top surface and an ink supply port 15 integrally formed therewith at a bottom surface 13 thereof. Ink supply port 15 resiliently engages with a hollow ink supply needle 14 as more particularly described below. Housing 11 is tapered in such a manner that the bottom surface 13 is smaller in diameter than the top surface of the ink tank cartridge. In an alternative embodiment, housing 11 may be formed in a cylindrical shape having straight walls.

Ink supply port 15 is pipe-like shaped and projects inwardly and outwardly from the bottom wall of housing 11. More specifically, ink supply port 15 is mounted so that it partially extends into the chamber of housing 11 and partially extend away from bottom surface 13 of housing 11. A mesh filter 17 having a pore size of about 20 to 100 μm is fuse bonded onto an inner opening 16 of ink supply port 15 projecting towards the inner chamber of housing 11. In the preferred embodiment, filter 17 may be formed of a high polymer material or an anti-corrosion metal such as stainless steel. A step portion 18 is formed in the inner wall of ink supply port 15 at a point spaced a short distance from the outer opening of ink supply port 15. A packing member 19 is provided for resiliently contacting ink supply needle 14 and is disposed inside ink supply port 15 at a lower side of step portion 18. This arrangement maintains the liquid (i.e. ink) in a sealed condition within ink supply port 15.

Figure 3:
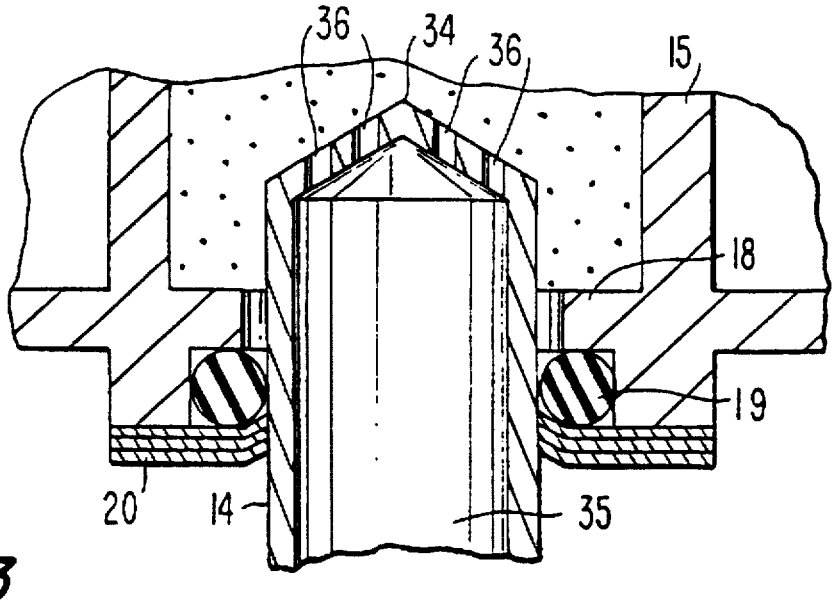
FIG. 3 is an enlarged sectional view of an ink supply needle penetrating the ink tank cartridge of FIG. 2.

In this embodiment, packing member 19 is formed of a rubber ring, and more specifically, an O-ring. A sealing film 20 as shown in FIG. 3 is fuse bonded onto the outer opening of ink supply port 15. In a preferred embodiment, film 20 is formed of a sealing material such as a high polymer film or a high polymer film with a metal layer laminated on the film. In this manner, film 20 demonstrates a high sealability so that it is not torn by an external force such as a contact by a finger of the user.

A porous member 21 is constructed with a width slightly wider than opening 12 of housing 11 and has a height slightly greater than housing 11. In a preferred embodiment, porous member 21 is formed from urethane foam. Porous member 21 is compressed in the chamber of housing 11. Further, the lower end portion of porous member 21 faces filter 17 of ink supply port 15. The central region of this lower end portion of the porous member is compressed against and by ink supply port 15 protruding inside the housing. A lid 22 covers opening 12 of housing 11 and includes a plurality of ribs 25 projecting towards the inner chamber of housing 11 so that lid 22 further compresses porous member 21 and holds it in the desired position. Moreover, spaces 24 are formed within ink tank cartridge 11 between lid 22 and porous member 21 to maintain a constant air pressure therein. Spaces 24 communicate to the outside air (atmospheric pressure) through air vent 23.

Because of the compression of porous member 21 by ink supply port 15, the pores of the compressed region of porous member 21 near ink supply port 15, and in particular facing the inner opening of the ink supply port, are smaller than the pore size of the remainder of porous member 21. Moreover, as shown in the embodiment disclosed in FIG. 12 as will be detailed below, the pore size of a second porous member positioned in ink supply port 15 between filter 17 and packing member 19 may be smaller than the ports of the compressed region of porous member 21.

Figure 4:
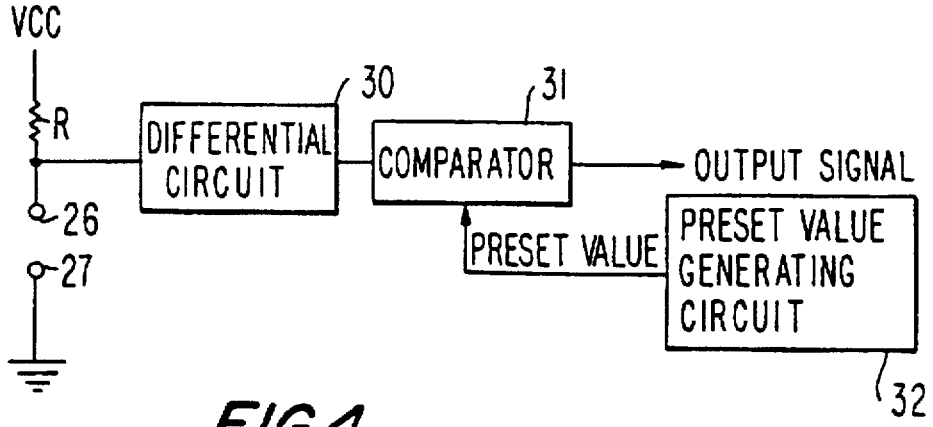
FIG. 4 is a circuit-block diagram of an ink end detection circuit.

A first electrode 26 is provided in ink supply port 15, while a second electrode 27 is provided in the chamber of the housing adjacent bottom surface 13 of housing 11 to form an ink end sensor to detect an ink end condition. This condition is present when the ink is almost empty in the tank so that ink is present essentially only ink supply port 15. As shown in FIG. 4, an AC voltage Vcc is applied to electrodes 26, 27 through a resistor R. A variation in voltage between electrodes 26, 27 is detected by a differential circuit 30. A comparator 31 compares an output signal of differential circuit 30 with a preset value generated by a preset value supplying circuit 32. The output signal of comparator 31 represents a voltage variation ratio of the two inputs to the comparator. If the voltage variation ratio is larger than a preset value, that is, the ink impregnated in porous member 21 becomes almost empty, an ink end signal is output and the ink end condition is therefore detected.

Referring to FIG. 3, hollow ink supply needle 14 is formed with a conical end to cooperate with ink tank cartridge 200. A plurality of throughholes 36 are formed on a tip end surface 34 of ink supply needle 14 for communicating the ink contained within ink supply port 15 with an ink supply path 35 formed inside needle 14.

Ink was loaded into porous member 21 under low pressure of about 0.2–0.4 atmospheric pressure to fill essentially all of the pores of the porous member. Ink filled under low pressure is very useful as a means for maintaining good printing quality as taught in Unexamined Japanese Patent Application (OPI) No. Sho. 60-245560. In particular, such loading prevents the entrapment of air bubbles in the porous member and permits filling to the capacity thereof. After the ink is filled into porous member 21, ink tank cartridge 200 is packed for shipping in a bag formed of a highly sealable material. An example of this sealable material is a laminate film having aluminum layers. The laminate film may have an inner plastic layer to facilitate fusing.

Figure 5:
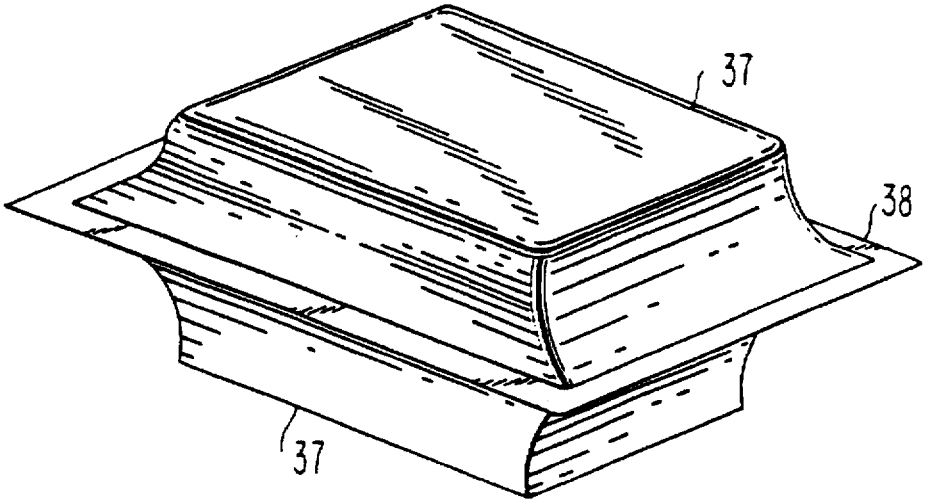
FIG. 5 is a perspective view of a container for storing the ink tank cartridge of FIG. 2.

FIG. 5 illustrates an example of a container for storing and packing ink tank cartridge 200 therein in accordance with the present invention. Ink tank cartridge 200 is wrapped by a pair of laminate films 37. Laminate film 37 is formed of a film including at least a layer of aluminum. More specifically, in a preferred embodiment, the film may be formed with a combination of polyethylene, glass and polyethylene teraphthalate. While decompressing (removing) air in the container, flange portions 38 of films 37 are fuse bonded to maintain the pressure in the container. The two step process forms a container with high sealibility. The container is formed so that there is a space between the container and the ink tank cartridge.

In a preferred embodiment, the space maintained in the container represents at least 15% of the total inside volume of the container after packed. In fact, a space representing more than 15% of the total internal volume is preferred. It is preferable that the ink tank cartridge be packed under a negative pressure which is slightly greater (closer to atmospheric pressure) than the pressure under which the ink is filled within the tank. In a preferred embodiment, the pressure in the space is about atmospheric, rather than the pressure at the time of ink impregnation.

In order to effectively prevent the deterioration of the printing quality due to the free gas produced in inks having dyes, low pressure must be maintained within the packaged container. At the same time, the amount of gas to be impregnated in the ink is lowered. Inks with dyes give off a very small amount of gas over a period of time. Further, even in case of using an ink which is not subjected with duration, the presence of the low pressure space within the container aids the ink in its duration process while stocked. Moreover, the ink is prevented from leaking from the container to the outside.

The low pressure value discussed above with respect to the packaging process under low pressure and the duration rate of ink under the low pressure condition after a stocking period will be described with reference to the amount of nitrogen as a main part of air.

TABLE 1

| Low pressure value (atmospheric pressure) | Amount of Nitrogen (ppm) |
|---|---|
| 0.5 | 7.5–9.0 |
| 0.35 | 7.0–8.5 |
| 0. | 6.0–7.5 |

According to the invention, the duration rate of the ink contained within ink tank cartridge 200 can be controlled by varying the pressure during the packaging process. Table 1 above discloses the packaging pressure (negative gauge pressure), the nitrogen density during the packaging process being set at a saturation level of 13–14 ppm. The table also discloses the nitrogen density impregnating into the ink contained in the ink tank cartridge, when the packaging container is opened. At the same time, FIG. 6 discloses the duration variation of ink contained in the ink tank cartridge after opening the container with reference to an amount of nitrogen contained in the ink.

Figure 6:
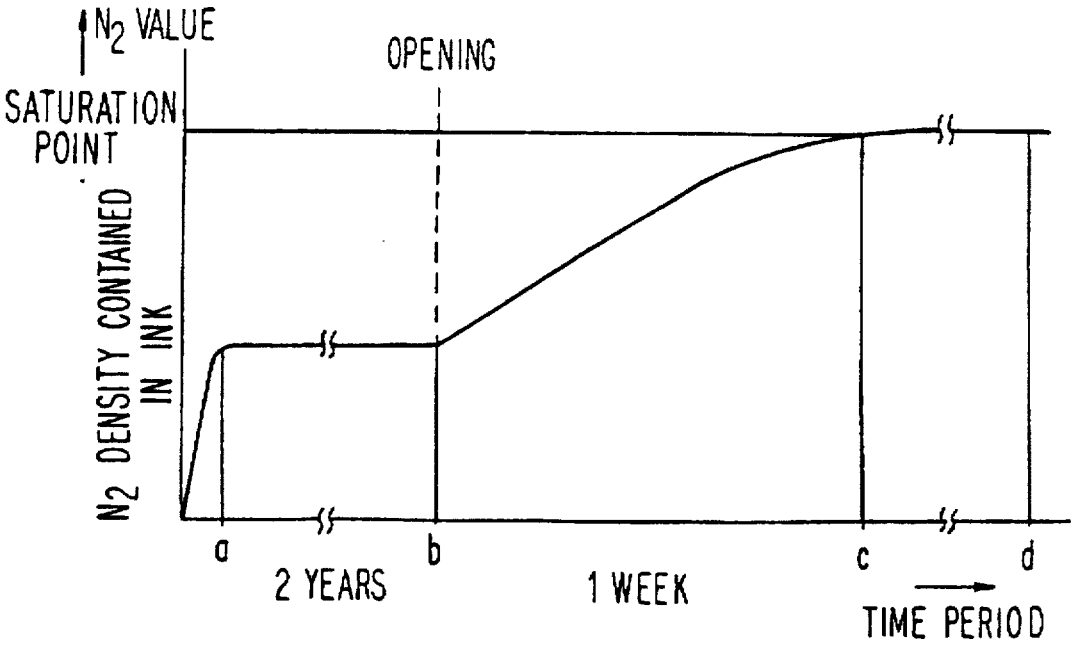
FIG. 6 is a graphical representation of the variation of the amount of nitrogen with respect to the ink during the life of the ink tank cartridge.

The arrangement of ribs 25 of lid 22 on the top of ink tank cartridge 200 form a space therein as set forth above. Therefore, a constant amount of air is stored in ink tank cartridge 200 corresponding to the pressure existing within the bag immediately after the packaging process. Accordingly, after a short period a, the density of nitrogen within the ink rapidly rises up as shown in FIG. 6. Thereafter, the density remains constant, because of the high sealability of the container. The constant level can be maintained for approximately two years from the manufacturing process. Once the container is opened at a point b, the amount of nitrogen contained in the ink increases and reaches a saturation point c approximately one week after opening. Even in the saturation condition, the printing quality does not deteriorate within period b to d, approximately one to four weeks later. In fact, once a cartridge is opened, a typical cartridge is used for printing for only a one to four week time period.

The duration effect of ink is set forth below. When ink tank cartridge 200 is removed from and attached to ink supply needle 14, the amount of air entering from the hollow needle is normally extremely small. More specifically, when a diameter of the hollow needle is about 0.8 mm, the air entering was less than 0.4 $mm^3$ which corresponds to an amount a meniscus of ink. Once the ink enters ink supply port 15 as shown in FIGS. 2 and 3, the ink flows towards recording head 4 and is trapped by a filter 17 (not shown) mounted in a filter chamber. The air trapped by filter 17 does not easily pass through filter 17, because the pore size of the filter is very fine. When employing a filter having a diameter of about 4 $mm^3$ and a thickness (height of filter chamber) of approximately 0.3 to 0.5 mm and after removing and attaching the ink tank cartridge to the needle many times, air does not pass through the filter, while the recording apparatus is operated.

Accordingly, during the period from point b to c of FIG. 6, the deaerated ink is supplied to the recording head. If ink tank cartridge 200 is removed and attached to ink supply needle 14 and air enters ink supply port 15 from needle 14, the air is impregnated into the ink. However, the recording apparatus does not suffer from any problems caused by this introduction of air.

On the other hand, when ink tank cartridge 200 is removed from the apparatus and left uncovered for a period of time, air will then enter from the hole in film 20 formed by the ink supply needle. As is well-known in the art, air destroys the siphon phenomenon and causes an undesired ink-failure in recording head 4. To prevent this problem, the ink-jet type recording apparatus is provided with a vacuum pump 7 as shown in FIGS. 1 and 2 for forceably ejecting ink from the ink nozzles and by applying a negative pressure to recording head 4. In this operation, the ability to recover from ink-failure depends on the duration rate of the ink. In case of using ink one to four weeks after the container is opened, no problem occurs when the air contained in the filter chamber is ejected by the operation of vacuum pump 7. On the other hand, after that time period, if the amount of air contained in the ink is completely saturated or may even be excessively saturated due to a variation in temperature, fine air bubbles may be generated by an action of negative pressure during the ink-failure preventing operation. This action causes an obstruction of ink flow from the ink tank cartridge.

Figure 7:
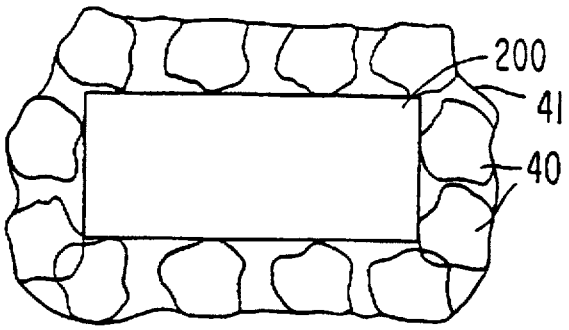
FIG. 7 is a sectional view of an alternative embodiment of the container of FIG. 5.

Referring now to FIG. 7, an arrangement for packaging ink tank cartridge 200 is disclosed in which cartridge 100 is surrounded by absorbing members such as sponge grains 40 and accommodated in a packaging bag 41. Bag 41 is subjected to a decompression process. According to this arrangement, since sponge grains 40 form a space inside packaging bag 41, the low pressure condition formed during the packing process can be continued for a long time period. If the ink is filled in porous member 21 of FIG. 2 to the greatest extent possible, for example, if approximately 95% of the volume of the porous member is represented by the ink accommodated in ink tank cartridge 200, the printing quality and efficiency of the ink-filling can be improved.

When ink tank cartridge 200 is packed in the manner described above, packaging bag 41 is opened and tank cartridge 200 is taken from bag 41. Ink tank cartridge 200 is then mounted on carriage 1 of FIG. 1 of recording apparatus 100 in such a manner that the outer opening of ink supply port 15 directed away from the bottom surface 13 is positioned just above ink supply needle 14. As shown in FIG. 3, ink tank cartridge 100 is then depressed in a direction parallel to the needle towards needle 14. Ink supply needle 14 penetrates sealing member 20 (i.e. film) and reaches packing member 19 (i.e. O-ring). In this condition, a tip end portion of ink supply needle 14 is maintained in a liquid sealing condition with respect to ink supply port 15 by packing member 19 (i.e. O-ring), while communicating with ink contained within ink supply port 15.

When ink supply needle 14 penetrates sealing member 20, sealing member 20 is deformed. In this manner, sealing member 20 conforms to the end contour of needle 14 until penetration, because of the resiliency of sealing member 20. Throughholes 36 formed at the tip end of ink supply needle 14 have a diameter in the range of about 0.1 to 0.4 mm. This range of sizes of throughholes 36 maintains a meniscus therein, when cartridge 200 is replaced or exchanged. Accordingly, air is prevented from entering ink tank cartridge 15 from ink supply needle 14, and therefore recording head 4. Further, since a plurality of throughholes 36 are provided, the fluid resistance applied to the ink flowing therethrough is very small. Accordingly, a sufficient amount of ink for the printing can be supplied to recording head 4.

Further, since porous member 21 is resiliently deformed and compressed by ink supply port 15 projecting inward in tank housing 11, the pore size of porous member 21 at a region in the vicinity of the ink supply port 15 is smaller than that of other regions therein so that the capillary force is large relative to the other regions. Based thereon, the ink is concentrated in the compressed portion of porous member 21, and further the ink can be supplied to recording head 4 until essentially the last droplet.

Figure 8:
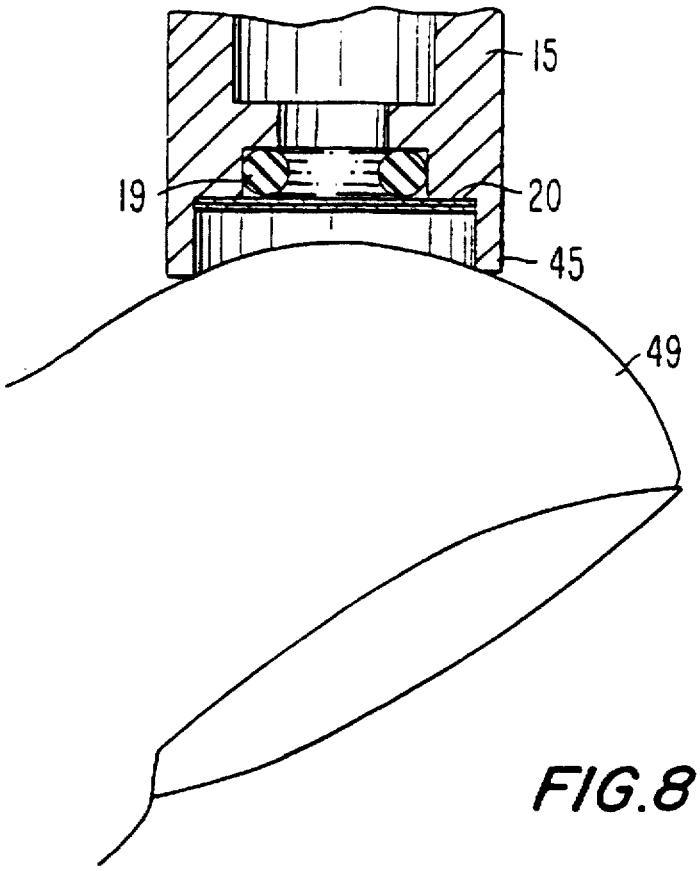
FIG. 8 is a sectional view of the ink tank cartridge of FIG. 2 having a flange.

In the above embodiment, sealing member 20 disposed at ink supply port 15 is exposed to a variety of elements when not connected. However, in a preferred embodiment, an axially extending flange 45 is formed surrounding sealing member 20 as shown in FIG. 8. Flange 45 provides protection from an unintentional touch of a finger 49 or other elements to sealing member 20. Flange 45 not only prevents sealing member 20 from being torn, but can also be used as a guide member for easily positioning ink supply needle 14 to the correct point for penetration.

Figure 9A:
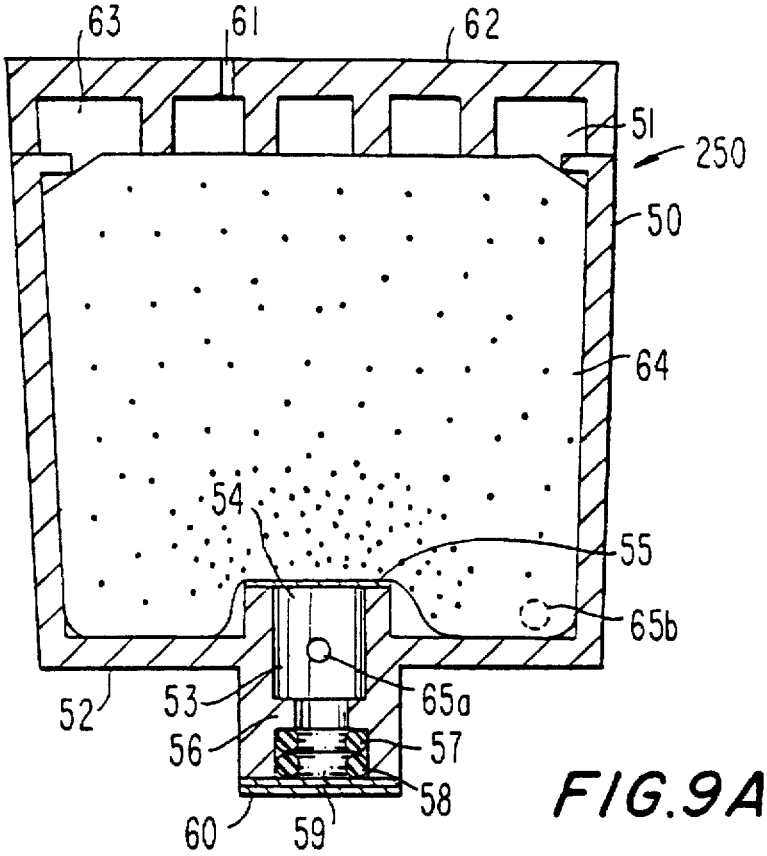
FIG. 9 is a sectional view an ink tank cartridge in accordance with an alternative embodiment of the invention.

Reference is now made to FIG. 9A which discloses an ink tank cartridge in accordance with another embodiment of the invention. An ink tank cartridge 250 of this embodiment is provided with a housing 50 forming the ink tank cartridge body. Housing 50 is provided with an opening 51 at a top surface thereof and a pipelike ink supply port 53 projecting from a bottom surface 52. Ink supply port 53 receives ink supply needle 14 disposed on the recording apparatus side. Housing 50 is tapered so that the bottom surface diameter is smaller than that of the top surface diameter. Ink supply port 53 is provided with an opening 54 onto which a filter 55, formed of high polymer or anti-corrosion metal, is fuse bonded thereon. A step portion 56 is formed in an inner wall of ink supply port 53 spaced from the outer end of port 53. A packing member 57 is fitted at the outer side (closer to the outer opening) of step portion 56 for maintaining liquid sealability by resiliently abutting against ink supply needle 14. In this embodiment, packing member 57 is an O-ring.

Further, a sealing stopping member 58 (i.e. film) is fitted below packing member 57. Sealing stopping member 58 is also an O-ring. An outer opening 59 is sealed by a sealing member 60 having a high air-sealability characteristics. For example, sealing member 60 is a laminated film through which ink supply needle 14 can easily penetrate. Opening 51 of housing 50 is sealed by a lid 62 having a vent hole 61. Hole 61 is provided for communication with the atmosphere. An inner surface of lid 62 is provided with a plurality of ribs 68 for defining spaces 63 between porous member 64 and lid 62 which communicate with vent hole 61 to maintain a constant air pressure within housing 50. Ink tank cartridge 250 is further provided with electrodes 65*a* and 65*b* for detecting an ink end condition.

Figure 9B:
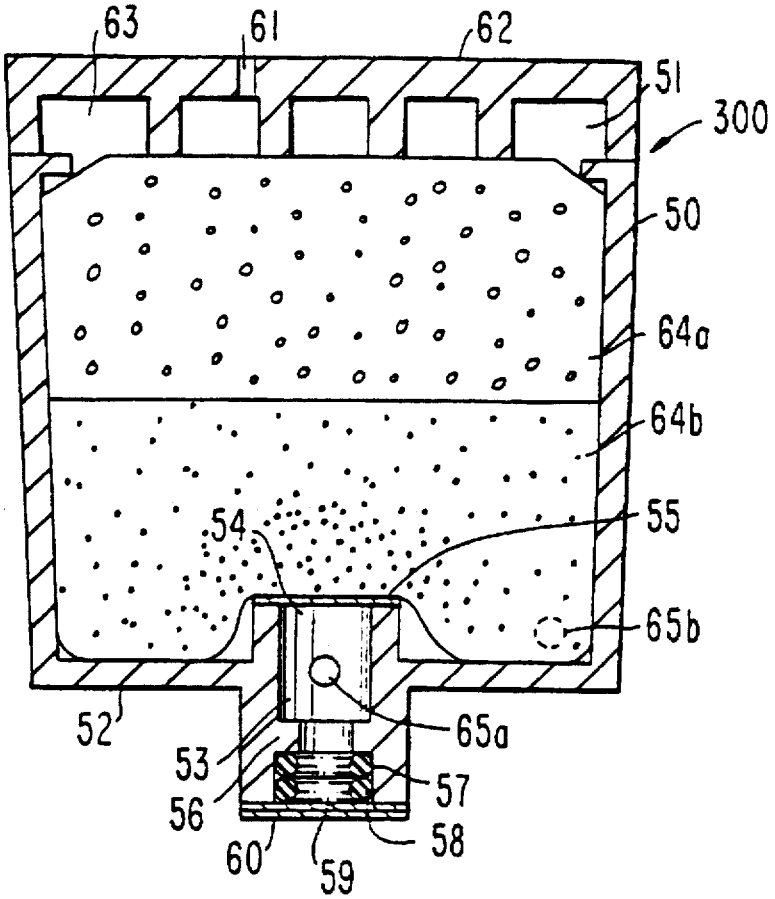

Referring now to FIG. 9B (like reference numerals being applied to like elements), an ink tank cartridge 300 is provided in accordance with another alternate embodiment of the invention. The porous member of FIG. 9A is formed in ink tank housing 50 of FIG. 9B with two separate porous members, an upper porous member 64*a* and a lower porous member 64*b*. Upper porous member 64*a* is larger in pore size than lower porous member 64*b* so that the capillary force is larger at the lower side, closer to ink supply port 53. The remaining elements of ink tank cartridge 300 are the same as the elements disclosed in ink tank cartridge 250 of FIG. 9A. Moreover, although the arrangement disclosed with respect to FIG. 9B has a porous member divided into two distinct layers, the porous member may be divided into more than two layers as long as each layer closer to the port has smaller pores than the layer further away.

With ink tank cartridges 250 and 300 described above, deaerated ink is filled within porous member 64 or 64*a* and 64*b* accommodated in tank housing 50 under low pressure. The ink tank cartridges are then packed in a package bag, similar to package bag 41 of FIG. 7, for stocking while maintaining a negative pressure slightly higher (i.e., closer to the atmosphere's pressure) than that during the ink-filling process. When ink tank cartridge 250 or 300 is exchanged with a new one, packaging bag 41 is opened to remove the new ink tank cartridge from the bag. The tank cartridge is then mounted on a carriage 1 of recording apparatus 100 in such a manner that a tip end opening of ink supply port 53 is positioned just above ink supply needle 14 and then depressed in the parallel direction parallel to the needle 14 towards needle 14.

In this operation, ink supply needle 14 penetrates sealing member 60 and reaches packing member 57 through sealing stopping member 58. After insertion, ink supply needle 14 is maintained in a liquid-tight condition with respect to ink supply port 53 by packing member 57. At the same time, ink supply needle 14 communicates with ink contained within ink supply port 53.

Figure 10A:
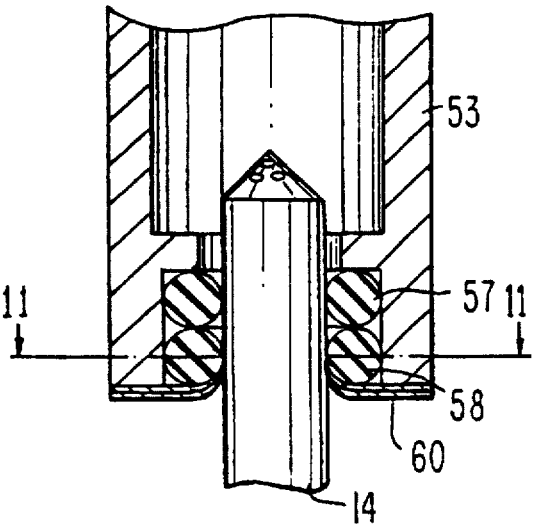
FIG. 10A is an enlarged sectional view of a sealing member and a sealing stopping member of FIG. 9.
Figure 11:
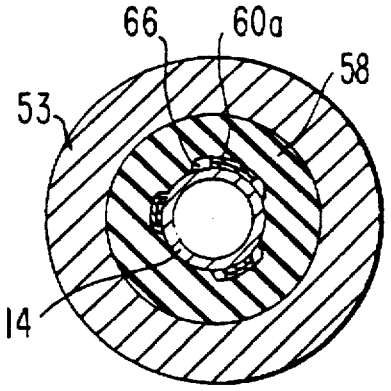
FIG. 11 is a sectional view taken along the line 11—11 of FIG. 10A.

When ink supply needle 14 penetrates sealing member 60, portions of sealing member 60 are broken off by the force of ink supply needle 14 entering ink supply port 53, as shown in FIG. 11, to form broken pieces 60*a*. However, based on the construction of the ink tank cartridge, broken pieces 60*a* of sealing member 60 are prevented from entering into ink supply port 53. This stoppage is caused by sealing stopping member 58 which forms an essentially tight grip with ink supply needle 14 as shown in FIGS. 10A and 11. Therefore, broken pieces 60*a* do not reach packing member 57. Accordingly, even if gaps 66 are formed between needle 14 and sealing stopping member 58, the liquid sealability can be maintained by packing member 57. Furthermore, the ink is prevented from leaking out of ink supply port 53.

Figure 10B:
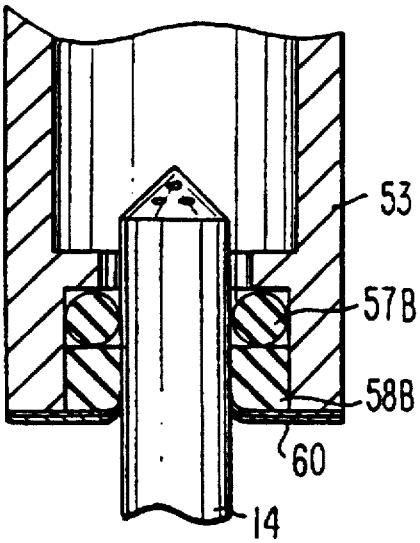
FIGS. 10B–10E are enlarged sectional views of alternative embodiments of the construction of FIG. 10A.
Figure 10C:
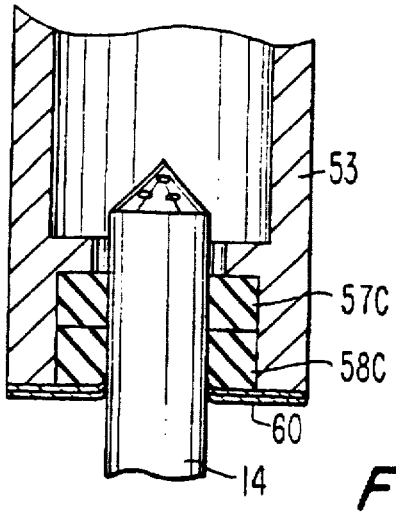
Figure 10D:
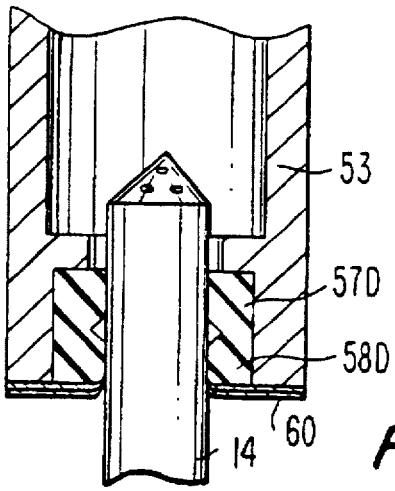
Figure 10E:
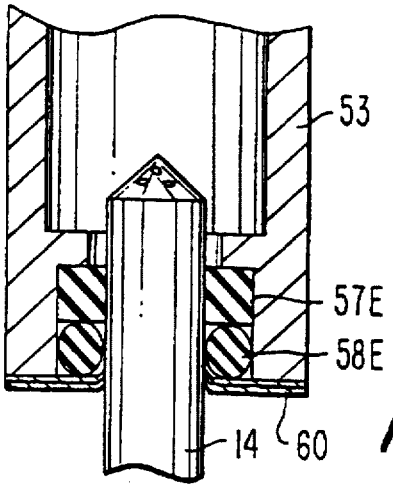

Reference is now made to FIGS. 10B–10E which disclose additional embodiments of ink tank cartridges 250 and 300 with respect to sealing member 57 and sealing stopping member 58. In all other respects, the ink tank cartridges are the same and like reference numerals are used for like elements. Although each sealing member and sealing stopping member of FIGS. 10B–10E are shaped and designed differently, the sealing member 57 and sealing stopping member 58 of FIG. 10A, each basically functions and operates in the same manner. In the arrangement disclosed in FIG. 10B, sealing stopping member 58B is an elastic sealing member, while sealing member 57B is an O-ring. In FIG. 10C, both sealing member 57C and sealing stopping member 58C are elastic sealing members. Referring to FIG. 10D, sealing member 57D and stopping sealing member 58D form a unitary block which is provided with a groove therebetween. Finally, in the configuration of FIG. 10E, sealing member 57E is an elastic sealing member, while sealing stopping member 58E is an O-ring.

Figure 12:
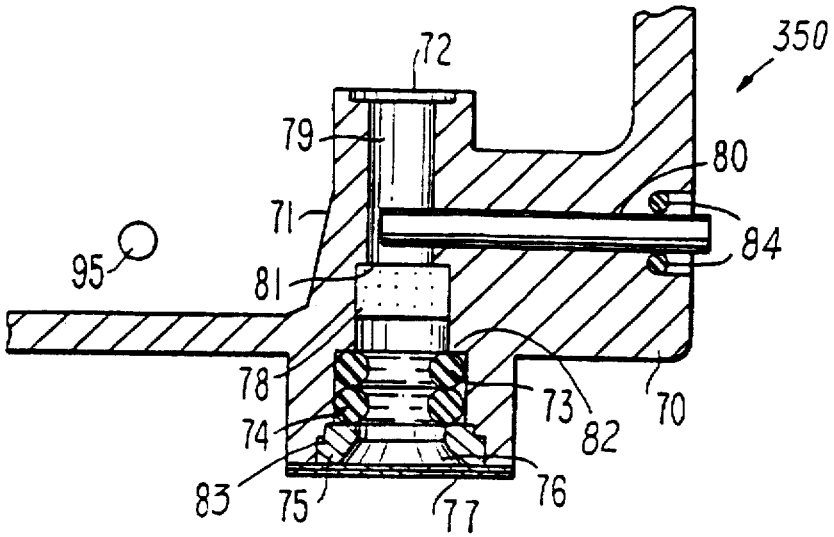
FIG. 12 is a fragmentary, enlarged sectional view of an ink tank cartridge in accordance with an alternative embodiment of the present invention.

Reference is now made to FIG. 12 which discloses an ink tank cartridge 350 in accordance with still another embodiment of the present invention. In this configuration, a pipe-like ink supply port 71 is formed on a bottom wall 70 of housing 90 for accommodating a porous member (not shown, but similar to porous member 21 of FIG. 2) for filling ink therein. A filter 72 is fixed to an inner opening 79 of ink supply port 71. The porous member impregnated with ink resiliently abuts against ink supply port 71 to be compressed thereby. The interior of ink supply port 71 is formed with several integral regions of increasing diameter from the region of inner opening 79. A packing member 73 and a seal stopping member 74 are press fitted in an inner portion of ink supply port 71 against step 82 and secured by a bushing 75 engaging steps 83. A lower opening 76 is sealed by a sealing member 77 (i.e. film).

An electrode 80 is disposed within ink supply port 71 in the vicinity of inner opening 79 for detecting an ink end condition. Ink tank cartridge 350 is further provided with a porous member 78 fitted against step 81 in ink supply port 71 between electrode 80 and packing member 73. In a preferred embodiment, porous member 78 is formed of a urethane foam. An upper portion of porous member 78 engages with step portion 81 formed inside ink supply port 71 to prevent porous member 81 from moving even when ink supply needle penetrates into ink supply port 71. Porous member 81 is preferably press fitted into position. A second electrode 95 is also provided for detecting the ink end condition in conjunction with first electrode 80. O-ring 84 provides a seal around the outer end of electrode 80, where it passed through bottom wall 70.

The purpose of porous member 78 is to avoid a false ink end condition by preventing air flow back to electrodes 80 of the ink end sensor when the ink tank cartridge is removed from the needle, but the ink is not yet exhausted. When porous member 81 is in position, ink from the main porous member (not shown) remains in the portion of the tubular passage in ink supply port 71 between inner end 79 and porous member 78 so that a false ink end condition is avoided. The ink stays in this location, because of a balance of pressure and meniscus forces. Normal atmospheric pressure is applied to both the top end of the main porous member within the chamber and the bottom end of porous member 81 now exposed to the atmosphere, because of the piercing of sealing member 77. Thus, the pressures are in balance. A balanced equilibrium is also developed between the meniscus force in the two porous members, thereby preventing air flow back to electrode 80 of the ink end sensor. The pore size of the main porous member may be selected to be less than the pore size of porous member 81, even when compressed.

Figure 13:
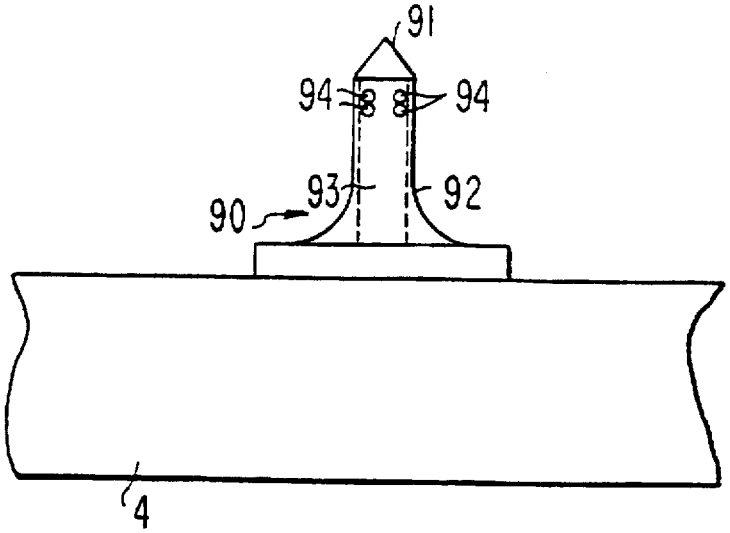
FIG. 13 is a front elevational view of an ink supply needle to be applied to the ink tank cartridge of FIG. 12.

An ink supply needle 90, as shown in FIG. 13, is applied to ink tank cartridge 350 of FIG. 12. Ink supply needle 90 is provided with a tip end 91 having a conical shape and an inclined surface for easily penetrating sealing member 77, sealing stopping member 74 and packing member 73 of ink tank cartridge 350 of FIG. 12. Needle body 92 has essentially parallel openings 94 in the side wall thereof communicating with an ink supply path 93.

Figure 14A:
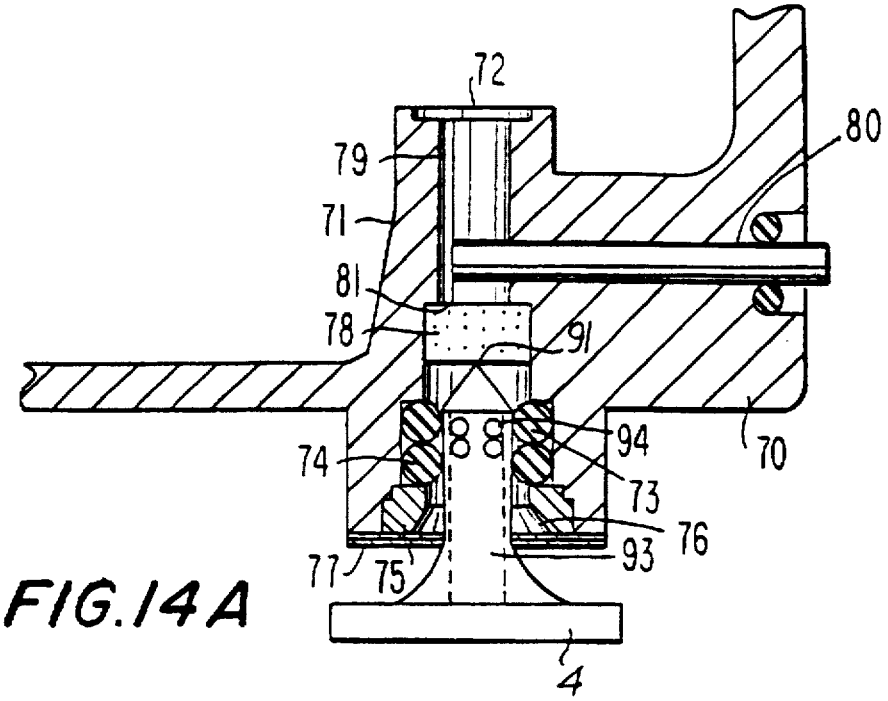
FIGS. 14A–B are sectional views of the penetration of the needle of FIG. 13 into the ink tank cartridge of FIG. 12.

To mount ink tank cartridge 350 with needle 90, sealing member 77 is positioned over ink supply needle 90. Ink tank cartridge 350 is then pushed downward onto tip 91 of needle 90 so that ink supply needle 90 penetrates sealing member 77 and passes through sealing stopping member 74 and packing member 73. Since ink supply needle 90 is not provided with holes at tip end portion 91 thereof, the variation in volume of ink in the interior of ink supply port 71, typically caused by a piston-effect during the mounting operation of the ink tank cartridge, is received by tip end portion 91 and packing member 73 as shown in FIG. 14A. However, packing member 73 essentially blocks the introduction of ink into openings 94 of ink supply needle 90. Therefore, the variation in volume of ink occurs in the upper side of ink supply port 71 through porous member 78, and not in ink supply path 93. Thus, when openings 94 pass through packing member 73 during the mounting process ink then flows into ink supply path 93 through openings 94 as shown in FIG. 14B.

As set forth above, during the mounting operation of ink tank cartridge 350, the undesirable variation in volume due to the piston effect applied to recording head 4 can be prevented. In particular, since ink supply path 93 does not immediately communicate with ink supply port 71, the leakage of ink from the nozzle opening of the recording head is effectively avoided. Further, it is not necessary to form the throughholes in the tip portion of needle 90, since ink supply needle has sufficient mechanical strength. Accordingly, needle 90 can be formed of a material other than metal such as, for example, a high polymer material. The ink supply needle formed of a high polymer material is advantageous in that the manufacturing process can be simplified. Moreover, the danger typically associated with a metal needle can be avoided.

Furthermore, the inner diameter of through holes 94 can be freely selected to the extent that the construction maintains a meniscus. The outer diameter of the ink supply needle can also be designed large as long as it controls an appropriate flow resistance of the ink through the needle. If needle 90 is formed of the high polymer material, the ink supply needle can maintain a mechanical strength sufficient for penetrating into ink tank cartridge 350.

Figure 14B:
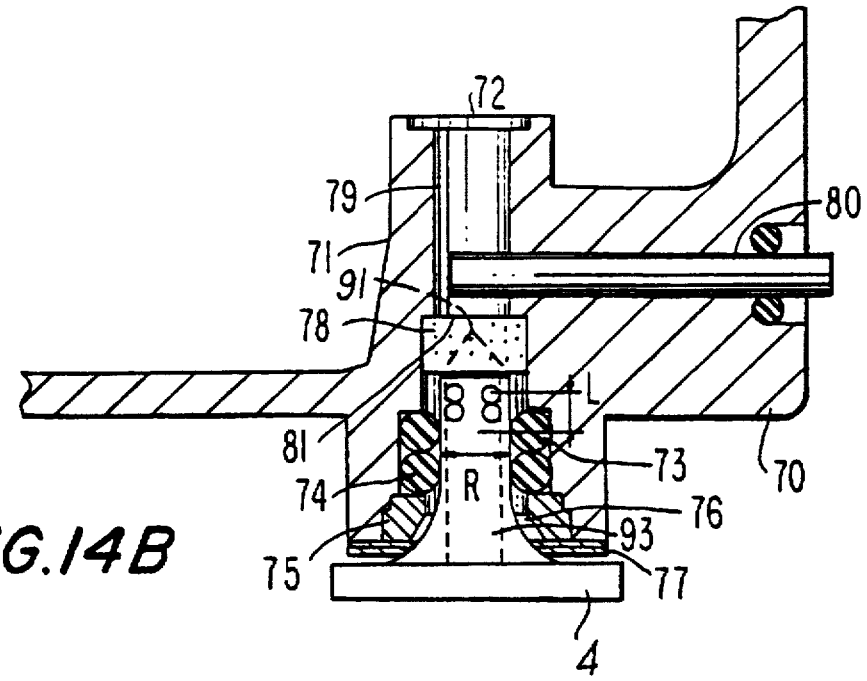

In a preferred embodiment, ink supply needle 90 shown in FIG. 14B is designed to meet specific parameters. For example, an outer diameter R of needle 90 is within a range of approximately 2–4 mm. Moreover, a length L between the center of the throughholes 94 closest to top end 90 of the needle and the center of packing member 73 when the ink tank cartridge is mounted onto the needles, also as shown in FIG. 14B, is set to a value less than about 2.5 mm. This arrangement is more preferable because the variation in volume when the ink tank cartridge is mounted on the ink supply needle is small and the undesirable piston effect can be minimized.

On the other hand, when ink tank cartridge 350 must be removed from ink supply needle 90 even though the ink is still filled within the tank (i.e. maintenance), ink existing around tip end 91 of ink supply needle 90 is sucked up toward porous member 78, since tip end 91 compresses porous member 78 when fully inserted, as shown in FIG. 14B. In this operation, since porous member 78 has a capillary force which is substantially the same as that of the porous member filled in the tank cartridge, and because of the balance of pressure and meniscus forces the ink remains in the interior of ink supply port 71 between porous member 78 and filter 72. Accordingly, the air is prevented from entering tank cartridge body 90. Further, if ink tank cartridge 350 is removed and remounted, electrodes 80 and 95 do not output a false signal indicating an ink end condition. As a result, the printing operation can be restarted merely by remounting ink tank cartridge 350 onto ink supply needle 90.

Needle 90 discloses parallel throughholes 94. However, other throughholes may be formed at an end surface thereof as shown in FIG. 3 as long as the piston effect during the mounting of the cartridge is small. Further, ink tank cartridge 350 utilizes bushing 75 to prevent packing member 73 and sealing stopping member 74 from falling out from ink supply port 71. However, bushing 75 may be omitted if the mechanical strength of sealing member 77 is relatively large.

Figure 15A:
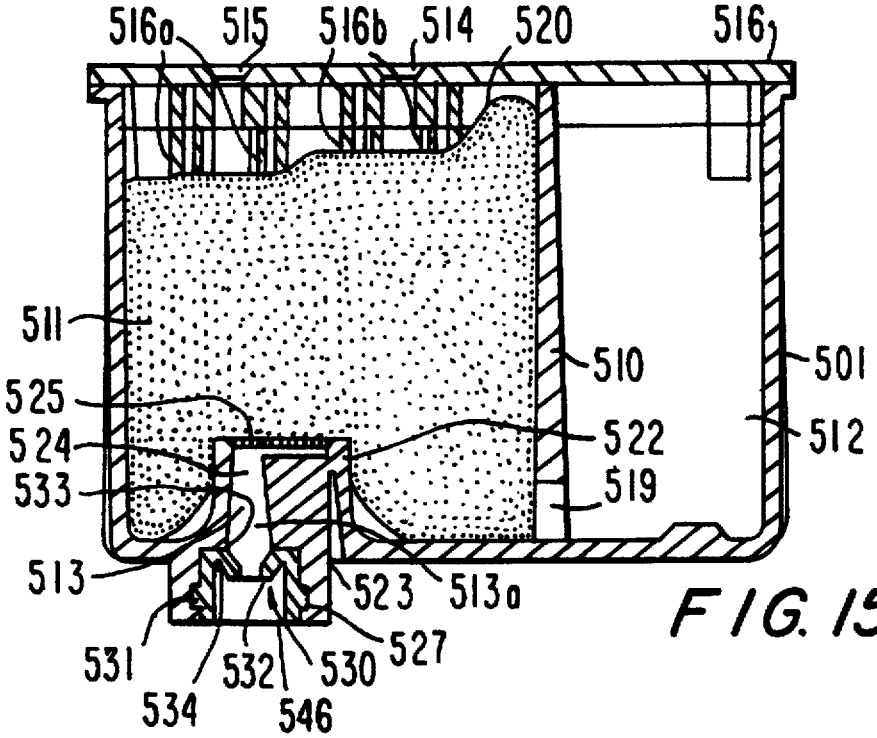
FIGS. 15(*a*) and (*b*) are cross-sectional views showing a first additional embodiment of a multi-color ink jet printer cartridge constructed in accordance a first additional embodiment of the invention.
Figure 15B:
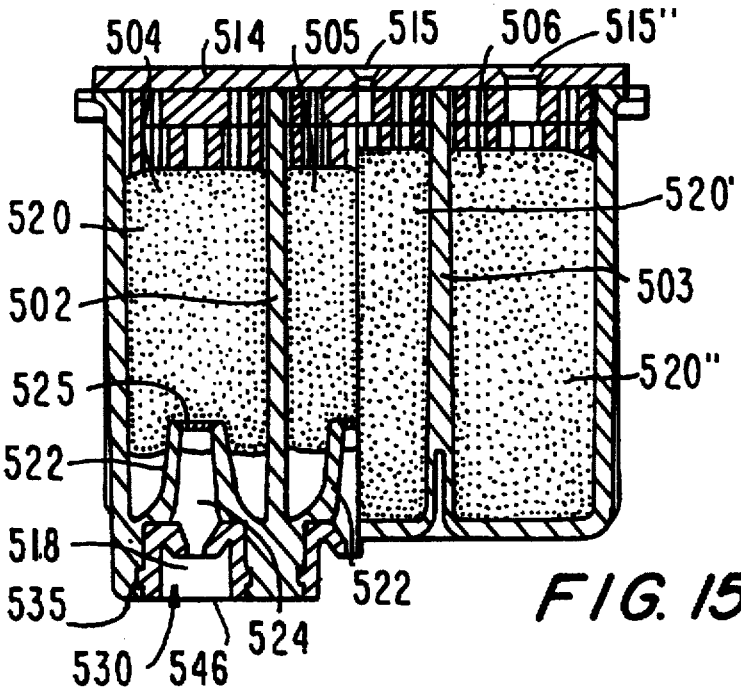
Figure 16:
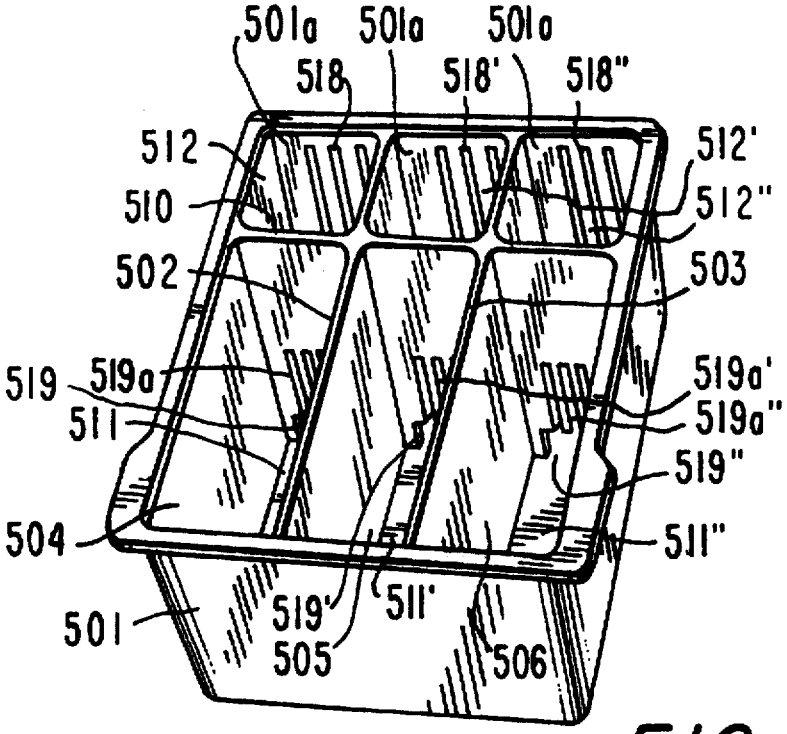
FIG. 16 is a perspective view showing the ink cartridge of FIGS. 15(*a*) and 15(*b*) with the lid removed.

Reference is first made to FIGS. 15(*a*) and 15(*b*) which depict an ink cartridge constructed in accordance with a first additional embodiment of the invention. A main container 501, is divided into three compartments 504, 505, and 506 by partitions 502 and 503 as shown in FIG. 16. Each of the three compartments 504, 505, and 506 is divided by a center partition wall 510 into foam chambers 511, 511' or 511" housing a respective porous member 520, 520' or 520" and ink chambers 512, 512' or 512" which are adapted to contain liquid ink. Foam chambers 511, 511', 511" are dimensioned to receive a respective porous member 520, 520' 520".

The volume of each of porous members 520, 520' and 520" is selected so as to be larger than the capacity of each of the respective foam chambers 511, 511' or 511", so as to be compressed while being retained in the respective foam chamber in a preferred embodiment. The ratio of the capacities of each foam chamber 511, 511' or 511" and each ink chamber 512, 512' or 512" is selected so that each foam chamber 511, 511' or 511" is dimensioned to hold 20 to 30% more ink than the respective ink chamber 512, 512' or 512".

When inks of three colors are contained within a single cartridge as in FIGS. 15(*b*) and 16, it may be difficult to see if different amounts of ink remain in the chambers, which may be caused by unbalanced consumption of the different color inks. When ink of one color is depleted, and the user wishes to dispose of the cartridge, the user need not unnecessarily worry about any remaining ink of the other colors in the cartridge leaking. When a cartridge of the invention is disposed of, ink is prevented from flowing out of the cartridge because ink of each color is absorbed by each respective porous member, thereby protecting the environment from any leakage of ink.

Ink supply ports 513, 513' and 513" (not shown), chambers 511 being exemplary of each chamber 511, 511' and 511" are formed in main container 501 within a respective foam chamber 511, 511', 511". Each ink supply port 513, 513' and 513" is adapted to engage with a respective ink supply needle (not shown) of the recording head which are inserted at the lower end of each of the foam chambers 511, 511' and 511".

Figure 18A:
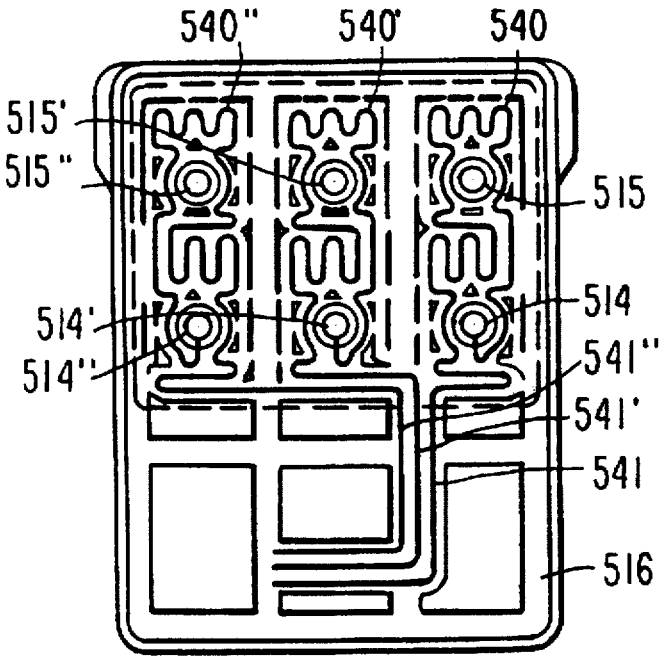
FIG. 18(*a*) is a bottom plan view of the lid of FIG. 15.
Figure 18B:
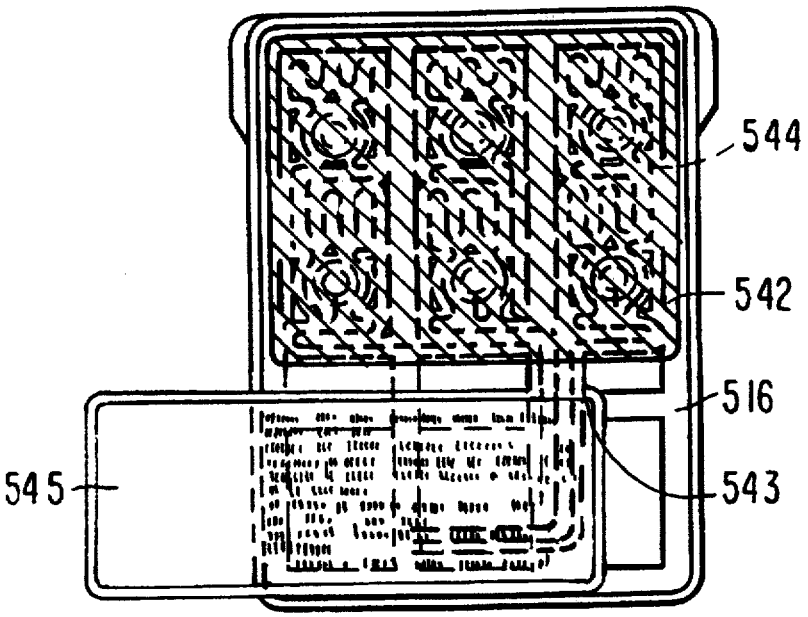

Referring now to FIGS. 15(*a*) and 15(*b*), the upper end of the main container 501 is sealed by a lid 516. Two ink filling ports 514 and 515 are formed at positions on lid 516 corresponding to foam chamber 511. Similarly, as shown in FIG. 18(*a*), each chamber 511, 511' and 511" includes corresponding ink filling ports 514 and 515, 514' and 515', and 514" and 515". Projections 516*a* and 516*b* are integrally formed with the inner surface of lid 516 and are positioned in foam chamber 511, so as to surround filling ports 515 and 514, respectively. Porous member 520 is compressed by projections 516*a* and 516*b* against the bottom wall of foam chamber 511 in which ink supply port 513 is formed. Projections 516*a*' and 516*b*', and 516*a*" and 516*b*" are similarly formed in the inner wall of lid 516, and are positioned in foam chambers 511' and 511", which contain ink supply ports 513' and 513", respectively as shown in FIG. 15(*b*).

Projection 516*a* which opposes ink supply port 513 is formed with its lower tip located at a position lower than the lower tip of projection 516*b*, whereby the portion of porous member 520 in the vicinity of ink supply port 513 is compressed to the greatest extent.

Protrusion portions 522, 522' and 522" (collectively "522"), which cooperate with lid 516 to compress porous members 520, 520' and 520" respectively are formed on the bottom of each of foam chambers 511, 511' and 511". Recesses 523, 523' and 523" (collectively "523"), which define spaces having a fixed opening area, are formed at the upper end of respective protrusion portions 522. Through holes 524, 524' and 524" (collectively "524") are disposed within the respective protrusion portions 522. One end of each through hole 524 is in fluid communication with the spaces defined by recesses 523 and the other end with a respective packing (collectively "530"), which will be hereinafter described. Filters 525, 525' and 525" (not shown) (collectively "525") are fixed to the upper end of recesses 523 respectively.

Packing members 530 of which only 530 is shown, are disposed at the lower end of ink supply ports 513, 513' and 513" respectively and are made of a resilient material such as rubber. Packing members 530, are configured as a funnel-shaped packing which opens upward. The lower ends of tubular portions 531 are thicker than the other portions. The respective upper peripheral edges 533 of taper portions 532 of respective packing members 530 contact with step portions 513*a* of respective ink supply ports 513, 513' and 513". Each packing member 530 is formed with protrusions 535 received by stepped portion 527 within the inner wall of ink supply port 513. The boundary between tubular portions 531 and taper portions 532, are configured as thin connection portions 534.

In this design, packing members 530 are fixed by tubular portions 531 to respective ink supply ports 513. Additionally, upward movement of upper peripheral edges 533 is prevented by respective step portions 513*a*. Thus, even when the respective ink supply needle is inserted or extracted, packing members 530 are adequately fixed to ink supply ports 513. Since taper portions 532 serve to attain the hermetic seal between the packing member of the respective ink supply port 513 and the ink supply needle by the respective thin connection portions 534, the taper portions can be moved somewhat without causing deformation. Consequently, the air tight seal between the respective packing member and ink supply needle can be maintained while accommodating a relative misalignment between the respective ink supply needle and ink supply port.

Communicating holes 519, 519' and 519" are formed in center partition wall 510, which separates foam chambers 511, 511' and 511" from ink chambers 512, 512' and 512" respectively. Slots 519*a*, 519*a*' 519*a*" which extend to a predetermined height are formed to be in communication with communicating holes 519, 519' and 519" respectively for gas-liquid replacement. Between each respective pair of foam and ink chambers 511 and 512, 511' and 512', and 511" and 512", porous members 520, 520' and 520" are housed in the foam chambers 511, 511' and 511" respectively in such a manner that each porous member is held against the respective communicating hole 519, 519' or 519". Ribs 518, 518', and 518" are formed on a back wall 501*a* of container 501 within a respective ink chamber 512, 512' and 512". An individual communication hole is formed between each respective chamber pair 511, 512, and extend along only a portion of the length of partition 510 formed thereat.

Figure 17:
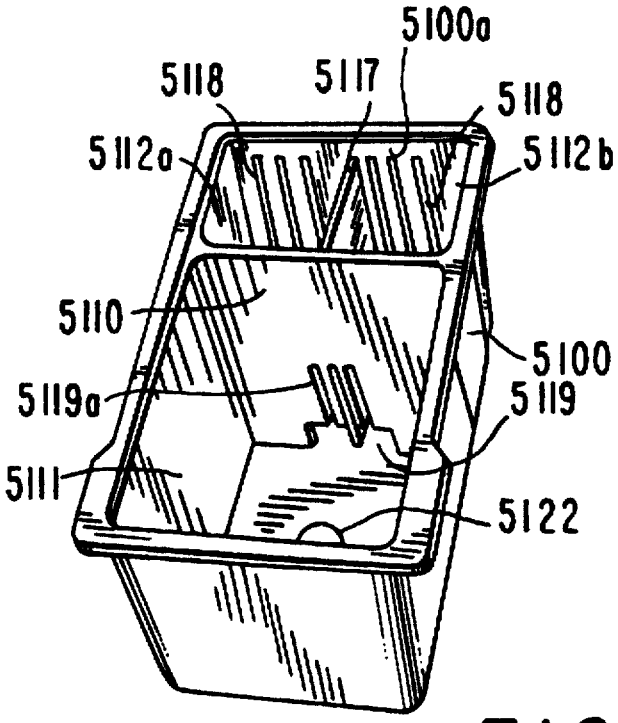
FIG. 17 is a perspective view showing a single color ink cartridge constructed in accordance with a second additional embodiment of the invention.

In a second additional embodiment of the invention an ink cartridge is utilized for a single color ink. A cartridge 5100 for a single color, or black ink can be made smaller in size than that for color inks, but the ink chamber 5112 for black ink would have a larger capacity than each of the corresponding chambers for a color ink. According to this embodiment of the invention, a cartridge for black ink is shown in FIG. 17 having a partition wall 5117 formed within a container 5100 so as to extend between center partition wall 5110 which separates a foam chamber 5111 from a ink chamber 5112 and a side wall 5100*a* of main container 5100, thereby dividing ink chamber 5112 into two cells 5112*a* and 5112*b*. This structure prevents container 5100 from being deformed by a negative pressure produced during the ink filling process which will be hereinafter described, or by an external pressure during usage, thereby preventing any ink from leaking. Cells 5112*a* and 5112*b* are retained in fluid communication with foam chamber 5111 via a communicating hole 5119 in center partition 5110 which extends along only a portion of the length of partition 5110. In addition, a communicating hole may be formed in the lower portion of partition wall 5117.

On the inner face of wall 5100*a*, which can easily be seen when the cartridge is mounted on a carriage, a plurality of ribs 5118 are formed which extend vertically along inner face 5100*a*. These ribs allow ink to flow more easily down along wall 5100*a*, and the user can easily recognize the amount of ink remaining in the cartridge by seeing the ink level.

Reference is now made to FIG. 18 which depicts lid 516 constructed in accordance with the first additional embodiment of the invention. Ink filling holes 514, 514' and 514", and 515, 515' and 515" are formed in the regions of lid 516 corresponding to the placement of porous members 520, 520' and 520" within container 501. Air communicating ports 541, 541' and 541" are connected to ink filling holes 514, 514' and 514" via grooves 540, 540' and 540", respectively.

When a seal 542 for covering ink filling holes 514, 514' and 514", 515, 515' and 515", and air vent ports 541, 541' and 541" is fixed to the upside of lid 516, after ink foam chambers 511, 511' and 511" are filled, grooves 540, 540' and 540" form capillary tubes with seal 542. A tongue piece 545 of seal 542, which protrudes from lid 516, is formed with a neck portion 543 disposed in seal 542 at a midpoint of the route of air vent ports 541, 541' and 541". When tongue piece 545 is peeled from lid 516, tongue piece 545 is easily separated from seal 542. This in turn exposes air vent ports 541, but no other portions of the underside of seal 542.

In a preferred embodiment, seal 542 is formed with patterns such as characters and illustrations printed on its main portion 544 which permanently seals grooves 540, 540' and 540". Patterns, colors, or other printing different from that printed on main portion 544 of seal 542 may be placed on tongue piece 545 which is connected to main portion 544 of seal 542 via neck portion 543.

For example, in a further preferred embodiment, the main portion 544 of seal 542 has a blue background, black characters and other illustrations printed thereon. The background color of tongue piece 545 is a color such as yellow or red which contrasts with the background color of main portion 544. Characters and illustrations are printed on the background in colors which are mainly black or blue. In this way, main portion 544 and tongue piece 545 are distinguished from each other in color and pattern. Consequently, it is possible to call the user's attention to the need for the removal of tongue piece 545.

Each of ink supply ports 513, 153' and 513" are sealed by a film 546 (FIG. 15(*a*)), and ink filling needles are hermetically inserted into the ink filling holes 514, 514' and 514" and 515, 515' and 515" respectively. The first of filling holes 514, 514' and 514" is connected to evacuating means, and the second of the filling holes 515, 515' and 515" is closed.

The evacuating means reduces the pressure in each of foam chambers 511, 511' and 511" and in each of ink chambers 512, 512' and 512". When the pressure is reduced to a predetermined value, the evacuating operation is stopped and the first filling hole is closed. Thereafter, the second filling hole is placed in fluid communication with a measuring tube filled with ink. Ink contained in the measuring tube is drawn into the evacuated container and is then absorbed by respective porous member 520, 520' and 520" and thereafter flows into ink chamber 512, 512' or 512" via communicating holes 519, 519' or 519" respectively.

After the specified amount of ink flows into the appropriate ink chamber, seal 542 is fixed to the outer surface of lid 516 so that the ink filling holes 514, 514' and 514" and 515, 515' and 515", grooves 540, 540' and 540", and communicating ports 541, 541' and 541" are sealed under reduced pressure. Seal 542 thereafter maintains the reduced pressure states of foam chambers 511, 511' and 511" and ink chambers 512, 512' and 512".

Before use of the cartridge, tongue piece 545 of seal 542 is then peeled off so that tongue piece 545 is broken at neck portion 543 and is separated from main portion 544. Thus, ink filling holes 514, 514' and 514" are placed in fluid communication with air vent ports 541, 541' and 541" via grooves 540, 540' and 540". Also, foam chambers 511, 511' and 511" are placed in fluid communication with air vent ports 541, 541' and 541" and therefore ambient air, via grooves 540, 540' and 540". Thus, while the ink is prevented from evaporating, the ink cartridge is ventilated.

Figure 19A:
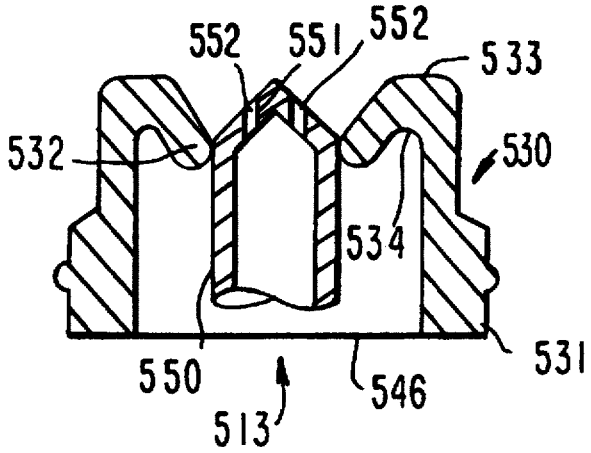
FIG. 19(*a*) is a cross-sectional view showing a packing member with an ink supply needle inserted therein in accordance with the invention.
Figure 19B:
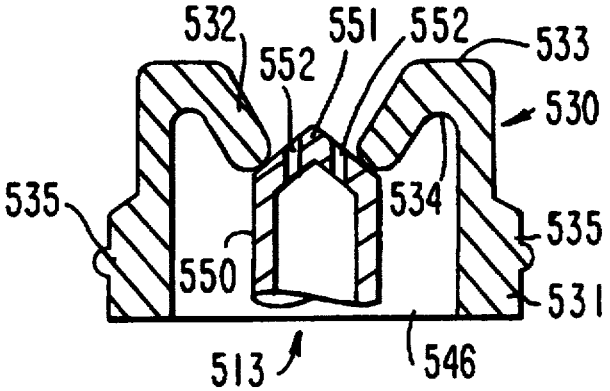

Reference is now made to FIG. 19, wherein an ink supply port 513 of the ink cartridge is positioned so as to be aligned with an ink supply needle 550 of the recording head. Thereafter the ink cartridge is pushed toward the recording head upon insertion of the ink cartridge. A taper portion 551 of ink supply needle 550 passes through a film seal 546 and engages the hole of packing member 530 as shown in FIG. 19(*a*). Since packing member 530 opens upward and the opened portion tapers upward, packing member 530 allows ink supply needle 550 to pass therethrough while packing member 530 is resiliently deformed by taper portion 551 of ink supply needle 550.

When the cartridge is used, ink supply needle 550 passes through packing member 530. The resiliency of connection portion 534 of packing member 530 enables taper portion 532 to engage ink supply needle 550. Even if ink supply needle 550 of the recording head and the center of packing 530 are somewhat misaligned, ink supply port 513 and ink supply needle 550 are hermetically sealed.

To conduct ink into the recording head after the ink cartridge is mounted, or to restart the flow of ink to the recording head, a negative pressure is applied to the recording head and through ink supply needle 550 so that ink in the cartridge flows through ink supply needle 550 and into the recording head. Because of the pressure difference, this high negative pressure applied to the cartridge causes taper portion 532 of packing member 530, which hermetically seals and isolates the cartridge from ambient air, to deform upward in FIG. 19(*a*) toward the interior of the ink cartridge. Thus, the pressure difference aids in causing taper portion 532 of packing member 530 to be resiliently pressed against ink supply needle 550, and thereby aids in hermetically sealing the ink cartridge.

Even if ink supply needle 550 is not positioned completely through packing member 530, the resilient force in taper portion 532 of packing member 530 allows taper portion 532 to remain in contact with ink supply needle 550 as long as the tapered portion 551 of ink supply needle 550 remains in contact with taper portion 532 as shown in FIG. 19(*b*). Consequently, it is possible to secure the air tightness of packing member 530 and ink supply needle 550 even if the needle is not properly inserted.

Since the tip of ink supply needle 550 is sealed upon contact with packing member 530, the dead space in the cartridge can be made very small, and any air bubbles which may be produced by the piston effect upon insertion of the cartridge onto the recording head are prevented from entering the cartridge.

When a negative pressure is applied from the nozzle openings of the recording head, ink absorbed by porous member 520 flows into the recording head via through hole 524 and through holes 552 of ink supply needle 550. When ink of a predetermined amount is consumed from porous member 520 and the ink level in porous member 520 is reduced, the pressure of ink chamber 512 overcomes the holding force of porous member 520 in the vicinity of communicating hole 519, so that air bubbles enter ink chamber 512 via communicating hole 519. Consequently, the pressure in a ink chamber 512 is increased and ink therefore flows into a foam chamber 511.

The ink flowing into foam chamber 511 is absorbed by porous member 520 and causes the ink level in foam chamber 511 to be raised. At the instant when the ink holding force of porous member 520 in the vicinity of communicating hole 519 is balanced with the pressure in ink chamber 512, the flow of ink from ink chamber 512 into foam chamber 511 is stopped.

Figure 20:
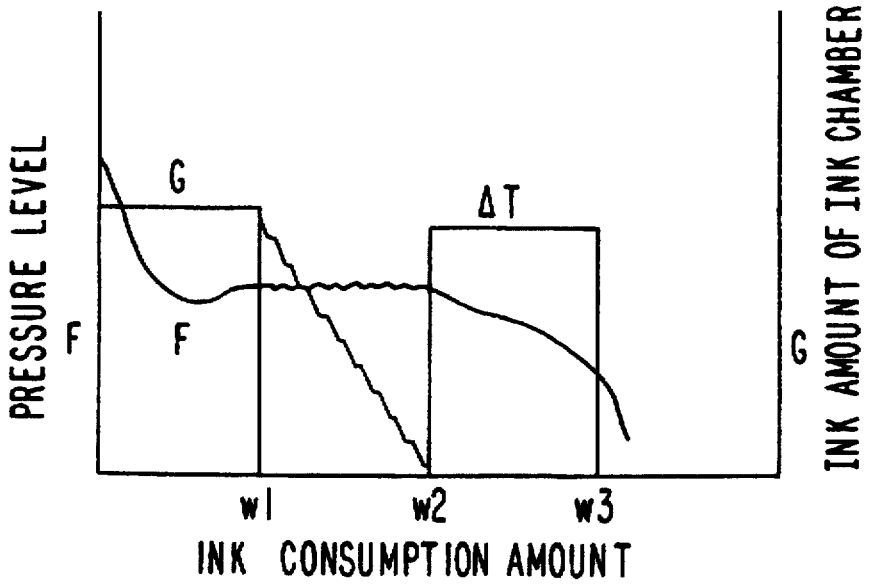
FIG. 20 is a graph showing the relationships of the ink consumption, the ink level, and the amount of ink remaining in an ink chamber.

The graph of FIG. 20 illustrates this process. In the figure, the letter F indicates the ink level in porous member 520 of foam chamber 511, and the letter G indicates the pressure level in ink chamber 512. When a predetermined amount of ink w1 which was initially contained in porous member 520 is consumed so that the ink level in porous member 520 is reduced to a predetermined value at which the pressure in ink chamber 512 overcomes the ink holding force of porous member 520 in the vicinity of communicating hole 519, ink gradually flows in a stepwise manner from ink chamber 512 into the foam chamber 511. This process occurs until the balance between the pressure of the ink chamber 512 and the ink holding force of porous member 520 in the vicinity of communicating hole 519 is restored. As a result, although the ink level in ink chamber 512 is gradually reduced, the ink level in porous member 520 can be maintained at a substantially constant level so that ink is supplied to the recording head by a constant pressure difference at a constant rate.

After a predetermined amount of ink w2 is consumed by the recording head, no ink will remain in ink chamber 512, but the amount of ink contained in porous member 520 will be at a level equal to the level when ink was intermittently being supplied to foam chamber 511 from ink chamber 512. Therefore, printing can be continued using the amount of ink absorbed in porous member 520, although further ink is available in ink chamber 512 to replenish the ink supply into porous member 520. After a predetermined amount of ink w3 is consumed during printing, the ink supply in porous member 520 will be depleted, and the ink cartridge will no longer support printing.

During the entire printing operation from when all the ink contained in ink chamber 512 is absorbed in porous member 520 until the ink is depleted, a constant amount of ink is supplied to the recording head. The depletion of ink from ink chamber 512 indicates the impending depletion of ink in the ink tank cartridge. If a fresh cartridge is inserted at this stage, it is possible to ensure a constant supply of ink to the recording head without interruption.

As described above, the inner space of the ink cartridge of the invention must be maintained at a negative pressure during the printing process. In addition to the achievement of the above-described hermetic seal between the ink supply port and the ink supply needle, the transfer of ink from ink chamber 512 to the foam chamber 511 must be performed properly to ensure a constant flow of ink to the recording head. Hereinafter, the structure for controlling the supply of ink from ink chamber 512 to foam chamber 511 will be described.

Figure 21:
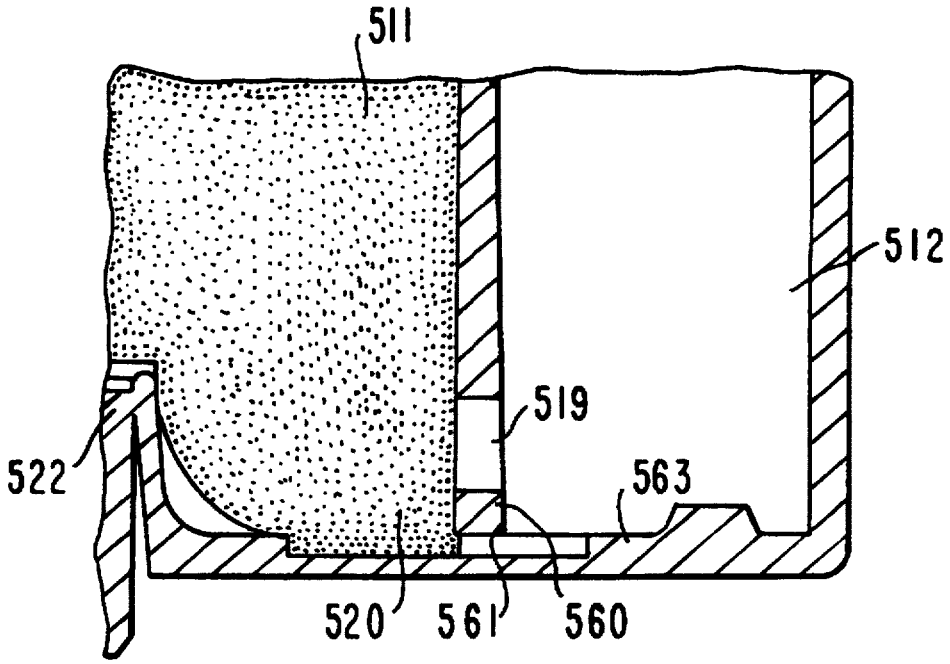
FIG. 21 is a partial cross-sectional view of the ink cartridge showing the boundary between ink and foam chambers.

Reference is now made to FIG. 21 which depicts the boundary between foam chamber 511 and ink chamber 512 in a third additional embodiment of the invention. Like numerals are utilized to indicate like structures, the primary difference between this embodiment and the first additional embodiment being a step portion formed in hole 519.

A step portion 560 is formed in communicating hole 519. A portion 563 of the base of ink chamber 512 is higher than that of foam chamber 511, step portion 560 being the dividing point. A groove 561 connecting the foam and the ink chamber is formed in the lower part of step portion 560.

Porous member 520 is in contact with communicating hole 519 and is received by step portion 560 so that the portion of porous member 520 in the vicinity of communicating hole 519 is compressed, whereby the required pressure difference between ink chamber 512 and foam chamber 511 via communicating hole 519 can be attained. When the ink level of ink chamber 512 is reduced to a low level, groove 561 enables ink from ink chamber 512 to be collected and then absorbed by porous member 520 in foam chamber 511. Consequently, all of the ink in ink chamber 512 can be supplied to the recording head for printing without wasting any ink.

Figure 22:
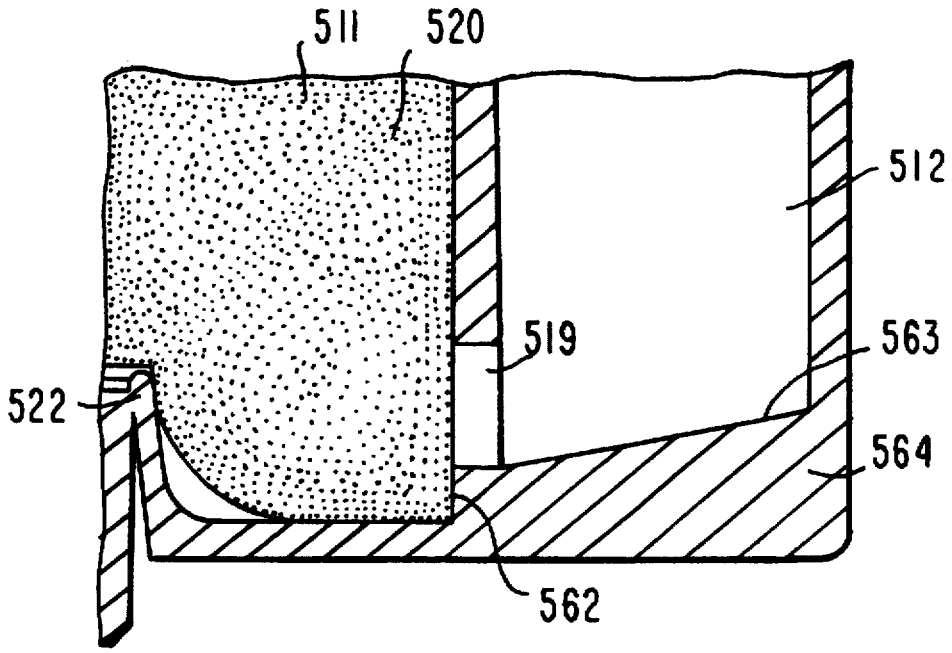
FIG. 22 is a partial cross-sectional view of the ink cartridge showing the boundary between ink and foam chambers.

Reference is now made to FIG. 22, which depicts an ink cartridge constructed in accordance with a fourth additional embodiment of the invention. Again, like numerals are used to indicate like structures, the primary difference between this embodiment and the first additional embodiment is the different leveled bottoms of the respective chambers.

The bottom face 564 of ink chamber 512 is higher than bottom face 567 of foam chamber 511, thereby forming a step portion 562. Step portion 562 receives the lower portion of porous member 520 so that the portion of porous member 520 in the vicinity of communicating hole 519 is compressed. When required, a slope 563 which is directed from the ink chamber 512 to the foam chamber 511 may be formed to aid in the supply of ink. Since slope 563 allows ink in ink chamber 512 to flow more easily toward foam chamber 511, irrespective of the inclination of the carriage, ink from ink chamber 512 can be constantly supplied to the recording head.

Figure 23A:
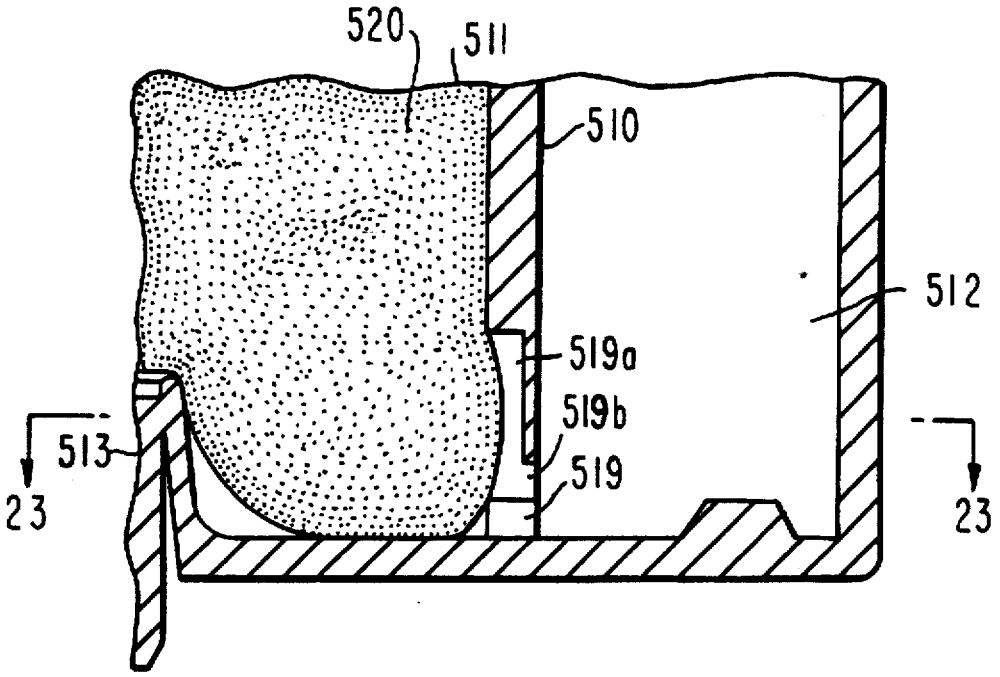
FIG. 23(*a*) is a partial cross-sectional view of the boundary between ink and foam chambers of an ink cartridge constructed in accordance with a third additional embodiment of the invention.
Figure 23B:
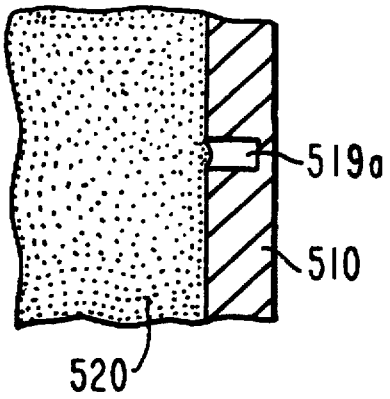

Reference is now made to FIGS. 23(*a*) and 23(*b*) which depict an ink jet cartridge constructed in accordance with a fifth additional embodiment of the invention. Like structures are indicated by like reference numerals, the primary difference between this embodiment and the first additional embodiment is the formation of a through hole. This embodiment is the same as the embodiment shown in FIGS. 16 and 17.

Groove 519*a* (FIGS. 16 and 17) is formed in the face of center partition 510 separating foam chamber 511 from ink chamber 512. Groove 519*a* is formed in the face of partition 510 on the side of the foam chamber 511 and is in communication with the upper portion of communicating hole 519 of center partition 510 within the respective chambers 511, 512. In order to allow air to pass from ink chamber 512 to foam chamber 511 and to retain these chambers in fluid communication with each other, a through hole 519*b* is formed in the lower end of the groove 519*a*. Thus, the upper portion of porous member 520 which exhibits a relatively small capillary force is maintained in fluid communication with communicating hole 519 via the space formed by thin groove 519*a*. Therefore, ink can be smoothly replaced with air so that ink in ink chamber 512 constantly flows into foam chamber 511, thereby preventing too much or not enough ink from being supplied.

Figure 24A:
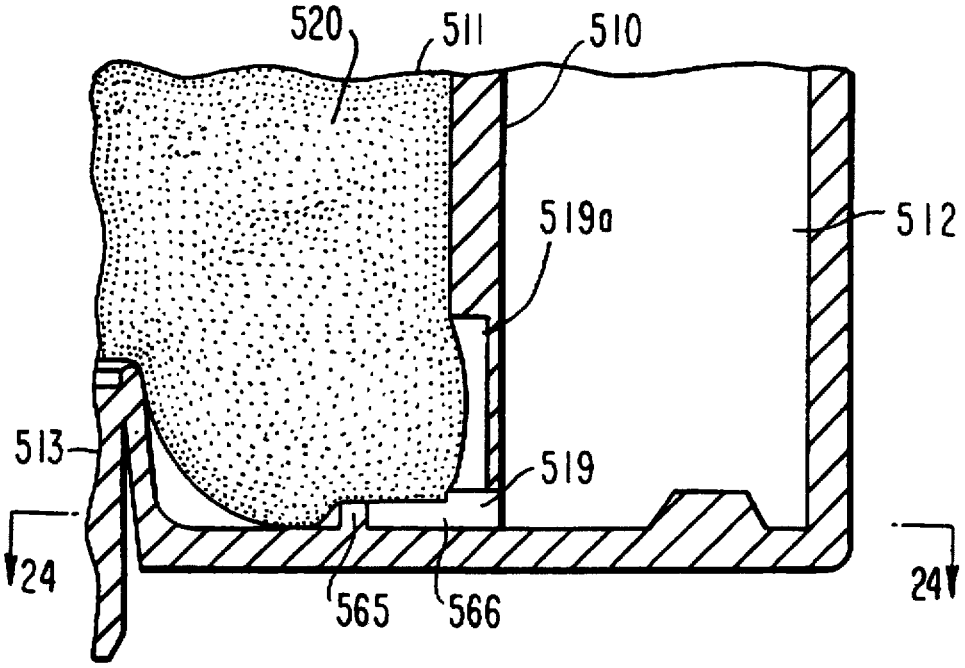
FIG. 24(*a*) is a partial cross-sectional view showing the boundary between ink and foam chambers of an ink cartridge constructed in accordance with a fourth additional embodiment of the invention.
Figure 24B:
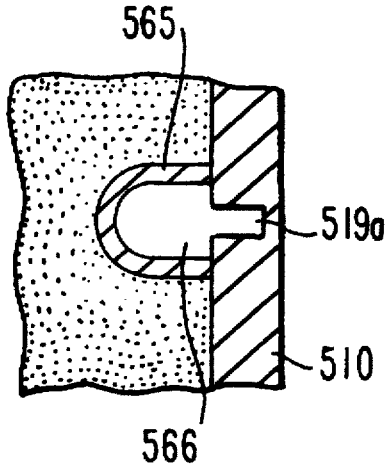

Reference is now made to FIGS. 24(*a*) and 24(*b*) which depict an ink cartridge constructed in accordance with a sixth additional embodiment of the invention. Like numerals are utilized to depict like structures, the primary difference being the use of a projection into foam chamber 511.

A horseshoe-shaped projection 565 is formed on the bottom of foam chamber 511 as is shown in FIG. 24(*b*). Projection 565 ensures a space in the vicinity of communicating hole 519 so that ink from ink chamber 512 can easily flow into foam chamber 511.

Figure 25A:
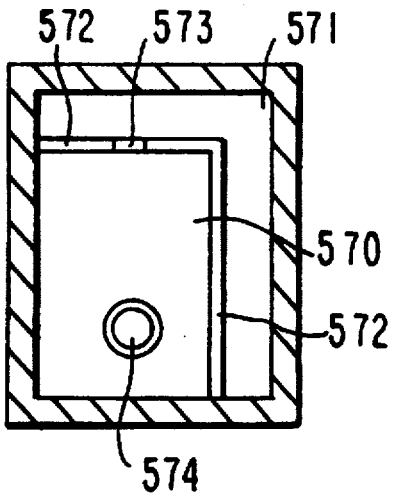
FIG. 25(*a*)is a cross-sectional view showing an ink cartridge constructed in accordance with a fifth additional embodiment of the invention.
Figure 25B:
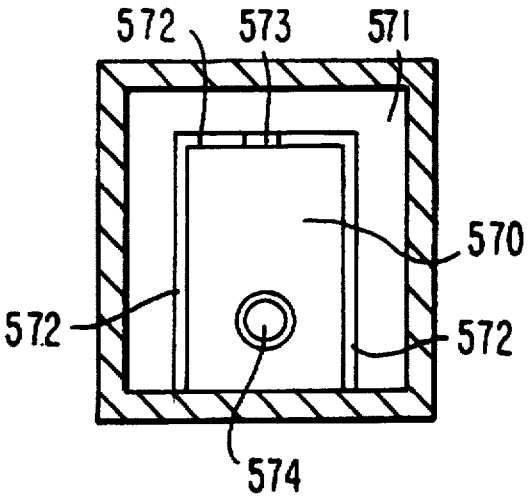

As described above, foam chamber 511 and ink chamber 512 are separated from each other by the single center partition 510. In a preferred embodiment of a single-color ink cartridge, as shown in FIGS. 25(*a*) and 25(*b*), an ink chamber 571 may be formed so as to surround two or three sides of a foam chamber 570, and a communicating hole 573 may be formed in at least one of the walls 572 separating the foam chamber 570 from the ink chamber 571. An exit port 574 is positioned within foam chamber 570. An ink cartridge of this design can store an amount of ink which is relatively large as compared with the volume of the whole ink cartridge. Furthermore, because of the location of the chambers, the user can easily see if replacement of the ink cartridge is required because of depletion of the ink.

Figure 26A:
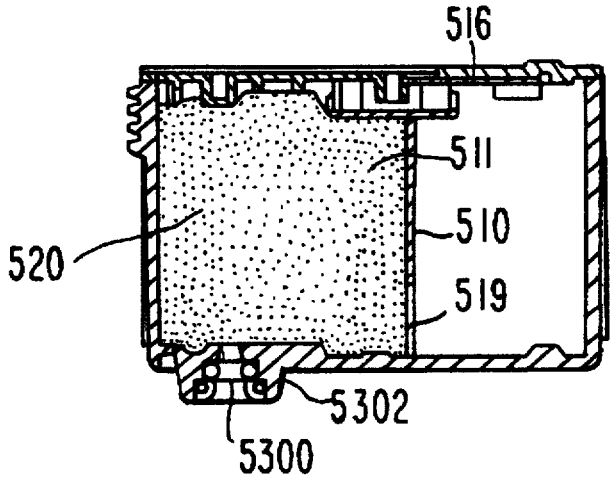
FIGS. 26(*a*) and 26(*b*) are cross-sectional views showing an ink cartridge for an ink jet printer constructed in accordance with a seventh additional embodiment of the invention.
Figure 26B:
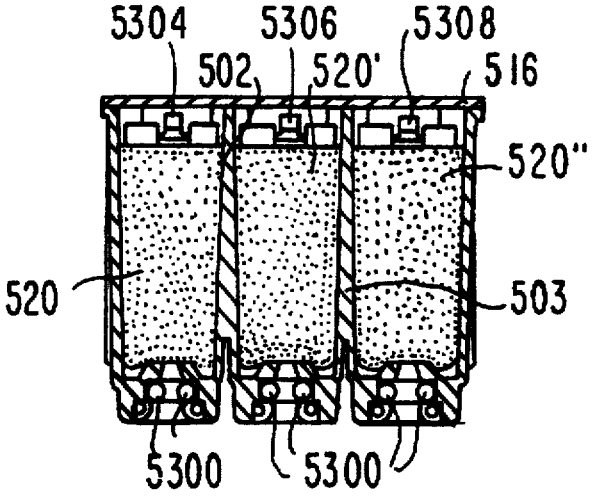

References is now made to FIGS. 26(*a*) and 26(*b*) wherein an ink jet printer cartridge constructed in accordance with a seventh additional embodiment of the invention is provided. This embodiment is similar to the first additional embodiment, the primary difference being the use of a resilient O-ring 5300 which is retained in contact with the peripheral face of an ink supply needle of the recording head upon insertion of the ink supply needle into the ink supply cartridge. However, this ink jet printer results in other problems solved by the first additional embodiment. A large frictional force may be produced when mounting the cartridge on the carriage and inserting the ink supply needle into the cartridge. This results in an extra strain on the recording head and the carriage. Furthermore, O-ring 5300 is supported at its periphery by the body 5302 of the cartridge. If there is a misalignment between the cartridge and the ink supply needle of the recording head upon insertion of the ink supply needle in the ink supply cartridge, it is very difficult to mount the cartridge. Furthermore, when a three color ink cartridge in which tanks 5304, 5306, and 5308 for the three color inks are integrated into one piece as shown in FIG. 26(*b*), it is extremely difficult to mount such a cartridge on the recording head if the cartridge and any of the ink supply needles are misaligned.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An ink tank cartridge for an ink-jet type recording apparatus, comprising:

a plurality of walls forming at least one chamber within said ink tank cartridge;

an ink supply port extending through at least one of said walls of said at least one chamber to permit ink to pass out of said at least one chamber; and a funnel-shaped packing member provided within said ink supply port, said packing member having a wide end dimensioned to engage said ink supply port, a narrow end dimensioned to be smaller than said ink supply port, and an opening therethrough having a wide end and a narrow end, said wide end of said opening being dimensioned to be larger than the ink supply needle, said narrow end of said opening dimensioned to receive an ink supply needle of an ink-jet type recording apparatus and to resiliently abut against an outer periphery of said ink supply needle, said packing member permitting ink to pass from said ink supply port only to said ink supply needle when said needle is positioned in said ink supply port.

2. The ink tank cartridge of claim 1, wherein said ink supply port includes a passage therethrough defined by an interior wall, said packing member including a support portion supported by said interior wall of said ink supply port coupled at a region thereof close to said at least one chamber to the wide end of said packing member.

3. The ink tank cartridge of claim 2, wherein said passage through said ink supply port includes a stepped region between a region of smaller cross sectional area closer to the at least one chamber and a region of larger cross-sectional area and abutting said stepped region.

4. The ink tank cartridge of claim 3, wherein said region of larger cross-sectional area of said passage includes a lateral groove, said support portion including a projection for receipt in said groove.

5. The ink tank cartridge of claim 4, wherein said support portion is essentially tubular in shape.

6. The ink tank cartridge of claim 1, wherein said at least one chamber include a first chamber; a second chamber for communicating with said first chamber through a passageway formed within said cartridge between said first and second chambers; and a porous member in said second chamber for transferring ink to said ink supply port, said first chamber being dimensioned to contain ink for transfer to said porous member in said second chamber.

7. The ink tank cartridge of claim 1, wherein said first and second chambers form an integrated unit.

8. The ink tank cartridge of claim 7, wherein said ink tank cartridge comprises a plurality of said integrated units forming a single integrated tank, each unit containing a respective different kind of ink.

9. The ink tank cartridge of claim 6, said ink supply port including a protrusion portion projecting into said second chamber and formed with an entrance opening to said ink supply port, and said protrusion portion engaging against and locally compressing a part of said porous member in the region of the entrance opening to said ink supply port.

10. The ink tank cartridge of claim 7, said ink supply port including a protrusion portion projecting into said second chamber and formed with an entrance opening to said ink supply port, and said protrusion portion engaging against and locally compressing a part of said porous member in the region of the entrance opening to said ink supply port.

11. The ink tank cartridge of claim 6, further including a projection for pressing said porous member against said ink supply port, said projection being formed on an inside portion of said second chamber essentially opposite said ink supply port.

12. The ink tank cartridge of claim 10, further including a projection for pressing said porous member against said ink supply port, said projection being formed on an inside portion of said foam chamber essentially opposite said ink supply port.

13. The ink tank cartridge of claim 6, wherein said porous member has a volume before insertion in said second chamber greater than the volume of said second chamber.

14. The ink tank cartridge of claim 10, wherein said porous member has a volume before insertion in said second chamber greater than the volume of said foam chamber.

15. The ink tank cartridge of claim 12, wherein said porous member has a volume before insertion in said second chamber greater than the volume of said foam chamber.

16. The ink tank cartridge of claim 9, further including a recessed portion formed on said protrusion portion and defining the entrance opening to said ink supply port, said ink supply port including an ink passage extending from said recessed portion away from said porous member, said recessed portion having a cross-sectional area greater than a cross-sectional area of said ink passage adjacent said recessed portion of said protrusion portion, and a filter disposed on said recessed portion between said porous member and said ink passage.

17. The ink tank cartridge of claim 1, further comprising at least one partition wall disposed within said at least one chamber to define a plurality of subchambers within said at least one chamber.

18. The ink tank cartridge of claim 1, further comprising a rib disposed within said at least one chamber, said rib being vertically elongated and positioned on an inner face of said at least one chamber.

19. The ink tank cartridge of claim 1, said ink supply port including an exit opening spaced from said at least one chamber and further including a sealing member separate from said packing member positioned to seal said ink supply port at about said exit opening and constructed to be penetrated by said ink supply needle when said ink tank cartridge is mounted on said ink supply needle.

20. The ink tank cartridge of claim 1, wherein said cartridge is constructed to be removably mounted on said recording apparatus so that an ink supply needle of said apparatus is received in said ink supply port.

21. An ink-jet type recording apparatus for outputting ink onto a recording medium, comprising:

a recording head for ejecting ink;

an ink supply needle coupled to said recording head and having at least one through hole to allow ink to pass therethrough; and an ink tank cartridge being removably mountable onto said ink supply needle of said ink-jet type recording apparatus, the ink tank cartridge, comprising:

a plurality of walls forming at least one chamber within said ink tank cartridge;

an ink supply port extending through at least one of said walls of said at least one chamber to permit ink to pass out of said at least one chamber; and a funnel-shaped packing member provided within said ink supply port, said packing member having a wide end dimensioned to engage said ink supply port, a narrow end dimensioned to be smaller than said ink supply port, and an opening therethrough having a wide end and a narrow end, said wide end of said opening being dimensioned to be larger than the ink supply needle, said narrow end of said opening dimensioned to receive an ink supply needle of an ink-jet type recording apparatus and to resiliently abut against an outer periphery of said ink supply needle, said packing member permitting ink to pass from said ink supply port only to said ink supply needle when said needle is positioned in said ink supply port.

22. The ink-jet type recording apparatus of claim 21, wherein said ink supply port includes a passage therethrough defined by an interior wall, said packing member including a support portion supported by said interior wall of said ink supply port coupled at a region thereof close to said at least one chamber to the wide end of said packing member.

23. The ink-jet type recording apparatus of claim 22, wherein said passage through said ink supply port includes a stepped region between a region of smaller cross sectional area closer to the at least one chamber and a region of larger cross-sectional area and abutting said stepped region.

24. The ink-jet type recording apparatus of claim 23, wherein said region of larger cross-sectional area of said passage includes a lateral groove, said support portion including a projection for receipt in said groove.

25. The ink-jet type recording apparatus of claim 24, wherein said support portion is essentially tubular in shape.

26. The ink-jet type recording apparatus of claim 21, wherein said at least one chamber includes a first chamber; a second chamber for communicating with said first chamber through a passageway formed within said cartridge between said first and second chambers; and a porous member in said second chamber for transferring ink to said ink supply port, said first chamber being dimensioned to contain ink for transfer to said porous member in said second chamber.

27. The ink-jet type recording apparatus of claim 21, wherein said first and second chambers form an integrated unit.

28. The ink-jet type recording apparatus of claim 27, wherein said ink tank cartridge comprises a plurality of said integrated units forming a single integrated tank, each unit containing a respective different kind of ink.

29. The ink-jet type recording apparatus of claim 26, said ink supply port including a protrusion portion projecting into said second chamber and formed with an entrance opening to said ink supply port, and said protrusion portion engaging against and locally compressing a part of said porous member in the region of the entrance opening to said ink supply port.

30. The ink-jet type recording apparatus of claim 27, said ink supply port including a protrusion portion projecting into said second chamber and formed with an entrance opening to said ink supply port, and said protrusion portion engaging against and locally compressing a part of said porous member in the region of the entrance opening to said ink supply port.

31. The ink-jet type recording apparatus of claim 26, further including a projection for pressing said porous member against said ink supply port, said projection being formed on an inside portion of said second chamber essentially opposite said ink supply port.

32. The ink-jet type recording apparatus of claim 30, further including a projection for pressing said porous member against said ink supply port, said projection being formed on an inside portion of said foam chamber essentially opposite said ink supply port.

33. The ink-jet type recording apparatus of claim 26, wherein said porous member has a volume before insertion in said second chamber greater than the volume of said second chamber.

34. The ink-jet type recording apparatus of claim 30, wherein said porous member has a volume before insertion in said second chamber greater than the volume of said foam chamber.

35. The ink-jet type recording apparatus of claim 32, wherein said porous member has a volume before insertion in said second chamber greater than the volume of said foam chamber.

36. The ink-jet type recording apparatus of claim 29, further including a recessed portion formed on said protrusion portion and defining the entrance opening to said ink supply port, said ink supply port including an ink passage extending from said recessed portion away from said porous member, said recessed portion having a cross-sectional area greater than a cross-sectional area of said ink passage adjacent said recessed portion of said protrusion portion, and a filter disposed on said recessed portion between said porous member and said ink passage.

37. The ink-jet type recording apparatus of claim 21, further comprising at least one partition wall disposed within said at least one chamber to define a plurality of subchambers within said at least one chamber.

38. The ink-jet type recording apparatus of claim 21, further comprising a rib disposed within said at least one chamber, said rib being vertically elongated and positioned on an inner face of said at least one chamber.

39. The ink-jet type recording apparatus of claim 21, said ink supply port including an exit opening spaced from said at least one chamber and further including a sealing member separate from said packing member positioned to seal said ink supply port at about said exit opening and constructed to be penetrated by said ink supply needle when said ink tank cartridge is mounted on said ink supply needle.

40. A system for mounting an ink tank cartridge onto an ink supply needle of an ink-jet type recording apparatus, the ink tank cartridge comprising:

a plurality of walls forming at least one chamber within said ink tank cartridge;

an ink supply port extending through at least one of said walls of said at least one chamber to permit ink to pass out of said at least one chamber; and a funnel-shaped packing member provided within said ink supply port, said packing member having a wide end dimensioned to engage said ink supply port, a narrow end dimensioned to be smaller than said ink supply port, and an opening therethrough having a wide end and a narrow end, said wide end of said opening being dimensioned to be larger than the ink supply needle, said narrow end of said opening dimensioned to receive an ink supply needle of an ink-jet type recording apparatus and to resiliently abut against an outer periphery of said ink supply needle, said packing member permitting ink to pass from said ink supply port only to said ink supply needle when said needle is positioned in said ink supply port.

41. The system of claim 40, wherein said ink supply port includes a passage therethrough defined by an interior wall, said packing member including a support portion supported by said interior wall of said ink supply port coupled at a region thereof close to said at least one chamber to the wide end of said packing member.

42. The system of claim 41, wherein said passage through said ink supply port includes a stepped region between a region of smaller cross sectional area closer to the at least one chamber and a region of larger cross-sectional area and abutting said stepped region.

43. The system of claim 42, wherein said region of larger cross-sectional area of said passage includes a lateral groove, said support portion including a projection for receipt in said groove.

44. The system of claim 43, wherein said support portion is essentially tubular in shape.

45. The system of claim 40, wherein said at least one chamber includes a first chamber; a second chamber for communicating with said first chamber through a passageway formed within said cartridge between said first and second chambers; and a porous member in said second chamber for transferring ink to said ink supply port, said first chamber being dimensioned to contain ink for transfer to said porous member in said second chamber.

46. The system of claim 40, wherein said first and second chambers form an integrated unit.

47. The system of claim 46, wherein said ink tank cartridge comprises a plurality of said integrated units forming a single integrated tank, each unit containing a respective different kind of ink.

48. The system of claim 45, said ink supply port including a protrusion portion projecting into said second chamber and formed with an entrance opening to said ink supply port, and said protrusion portion engaging against and locally compressing a part of said porous member in the region of the entrance opening to said ink supply port.

49. The system of claim 46, said ink supply port including a protrusion portion projecting into said second chamber and formed with an entrance opening to said ink supply port, and said protrusion portion engaging against and locally compressing a part of said porous member in the region of the entrance opening to said ink supply port.

50. The system of claim 45, further including a projection for pressing said porous member against said ink supply port, said projection being formed on an inside portion of said second chamber essentially opposite said ink supply port.

51. The system of claim 49, further including a projection for pressing said porous member against said ink supply port, said projection being formed on an inside portion of said foam chamber essentially opposite said ink supply port.

52. The system of claim 45, wherein said porous member has a volume before insertion in said second chamber greater than the volume of said second chamber.

53. The system of claim 49, wherein said porous member has a volume before insertion in said second chamber greater than the volume of said foam chamber.

54. The system of claim 51, wherein said porous member has a volume before insertion in said second chamber greater than the volume of said foam chamber.

55. The system of claim 48, further including a recessed portion formed on said protrusion portion and defining the entrance opening to said ink supply port, said ink supply port including an ink passage extending from said recessed portion away from said porous member, said recessed portion having a cross-sectional area greater than a cross-sectional area of said ink passage adjacent said recessed portion of said protrusion portion, and a filter disposed on said recessed portion between said porous member and said ink passage.

56. The system of claim 40, further comprising at least one partition wall disposed within said at least one chamber to define a plurality of subchambers within said at least one chamber.

57. The system of claim 40, further comprising a rib disposed within said at least one chamber, said rib being vertically elongated and positioned on an inner face of said at least one chamber.

58. The system of claim 40, said ink supply port including an exit opening spaced from said at least one chamber and further including a sealing member separate from said packing member positioned to seal said ink supply port at about said exit opening and constructed to be penetrated by said ink supply needle when said ink tank cartridge is mounted on said ink supply needle.

59. A method for removably mounting an ink tank cartridge for an ink-jet type recording apparatus onto an ink supply needle of said ink jet type recording apparatus, said ink tank cartridge including a plurality of walls forming at least one chamber within said ink tank cartridge, the method for comprising the steps of:

storing ink in said at least one chamber;

extending an ink supply port through at least one of said walls of said at least one chamber in said ink tank cartridge to supply ink to the ink-jet recording apparatus;

inserting said ink supply needle of the ink jet type recording apparatus into a funnel-shaped packing member provided within said ink supply port, said packing member having a wide end dimensioned to engage said ink supply port, a narrow end dimensioned to be smaller than said ink supply port and an opening therethrough having a wide end and a narrow end, said wide of said opening being dimensioned to receive said ink supply needle, said narrow end being dimensioned to receive said ink supply needle; and abutting said narrow end of said opening resiliently against an outer periphery of said ink supply needle of the ink jet type recording apparatus for permitting ink to pass from said ink supply port said only to ink supply needle when said needle is positioned in said ink supply port.

60. An ink tank cartridge for an ink-jet type recording apparatus, comprising:

a housing formed with a chamber therein;

an ink supply port extending through a wall of said housing, said ink supply port having a first opening directed toward said chamber of said housing and a second opening directed away from said wall of said housing; and a funnel-shaped packing member provided within said ink supply port, said packing member having a wide end dimensioned to engage said ink supple port, a narrow end dimensioned to be smaller than said ink supply port, and an opening therethrough having a wide end and a narrow end, said wide end of said opening being dimensioned to be larger than the ink supply needle, said narrow end of said opening dimensioned to receive an ink supply needle of an ink-jet type recording apparatus and to resiliently abut against an outer periphery of said ink supply needle, said packing member permitting ink to pass from said ink supply port only to said ink supply needle when said needle is positioned in said ink supply port.

61. The ink tank cartridge of claim 60, further including a sealing member separate from said packing member positioned to seal said ink supply port before said ink tank cartridge is mounted on said ink supply needle, said sealing member being penetrated by said ink supply needle when said ink tank cartridge is mounted on said ink supply needle.

62. An ink-jet type recording apparatus for outputting ink onto a recording medium, comprising:

a recording head for ejecting ink;

an ink supply needle coupled to said recording head and having at least one through hole; and an ink tank cartridge being removably mountable onto the ink supply needle, said ink tank cartridge comprising;

a housing formed with a chamber therein;

an ink supply port extending from a wall of said housing, said ink supply port having first opening directed towards said chamber of said housing and a second opening directed away from said wall of said housing; and a funnel-shaped packing member provided within said ink supply port, said packing member having a wide end dimensioned to engage said ink supply port, a narrow end dimensioned to be smaller than said ink supply port, and an opening therethrough having a wide end and a narrow end, said wide end of said opening being dimensioned to be larger than the ink supply needle, said narrow end of said opening dimensioned to receive an ink supply needle of an ink-jet type recording apparatus and to resiliently abut against an outer periphery of said ink supply needle, said packing member permitting ink to pass from said ink supply port only to said ink supply needle when said needle is positioned in said ink supply port.

* * * * *